US012571060B2

(12) United States Patent
Zhang et al.

(10) Patent No.: US 12,571,060 B2
(45) Date of Patent: Mar. 10, 2026

(54) JOINT REGULATION METHOD OF MATERIAL FLOW, ENERGY FLOW, AND CARBON EMISSION FLOW IN LONG-PROCESS IRON AND STEEL ENTERPRISES

(71) Applicant: NORTHEAST ELECTRIC POWER UNIVERSITY, Jilin City (CN)

(72) Inventors: Rufeng Zhang, Jilin (CN); Rui Yuan, Jilin (CN); Haihang Sun, Jilin (CN); Houhe Chen, Jilin (CN); Ershun Du, Jilin (CN); Jianpei Han, Jilin (CN)

(73) Assignee: NORTHEAST ELECTRIC POWER UNIVERSITY, Jilin (CN)

( * ) Notice: Subject to any disclaimer, the term of this patent is extended or adjusted under 35 U.S.C. 154(b) by 0 days.

(21) Appl. No.: 19/194,435

(22) Filed: Apr. 30, 2025

(65) Prior Publication Data

US 2025/0369060 A1 Dec. 4, 2025

(30) Foreign Application Priority Data

May 28, 2024 (CN) ..... 202410668647.5

(51) Int. Cl.

| | |
|---|---|
| ***C21B 5/00*** | (2006.01) |
| ***C21C 5/38*** | (2006.01) |
| ***C21C 5/56*** | (2006.01) |

(52) U.S. Cl.

CPC ..... *C21B 5/006* (2013.01); *C21C 5/38* (2013.01); *C21C 5/562* (2013.01); *C21B 2100/60* (2017.05); *C21B 2300/04* (2013.01); *C21C 2300/06* (2013.01)

(58) Field of Classification Search

None

See application file for complete search history.

(56) References Cited

FOREIGN PATENT DOCUMENTS

| | | | |
|---|---|---|---|
| CN | 111769555 | A | 10/2020 |
| CN | 115630268 | A | 1/2023 |
| CN | 116090188 | A | 5/2023 |
| CN | 117726092 | A | 3/2024 |
| CN | 117952363 | A | 4/2024 |
| WO | 2024092727 | A1 | 5/2024 |

OTHER PUBLICATIONS

First Office Action in Chinese Application No. 202410668647.5 mailed on Oct. 31, 2024, 11 pages.

Decision to Grant a Patent in Chinese Application No. 202410668647.5 mailed on Jan. 9, 2025, 5 pages.

*Primary Examiner* — Keith D. Hendricks

*Assistant Examiner* — Nikolas Takuya Pullen

(74) *Attorney, Agent, or Firm* — PORUS IP LLC

(57) ABSTRACT

Provided are a joint regulation method of material flow, energy flow, and carbon emission flow in a long-process steel enterprise, which belongs to a field of intelligent regulation and control technology of electric power system in the steel industry. The method includes: coupling a material-energy characteristic model of each production process of a steel enterprise and a carbon emission model of the steel enterprise, constructing a material flow-energy flow-carbon emission flow coupling model of the long-process steel enterprise, establishing an objective function using a minimize sum of an electricity purchase cost from a superior grid, a park carbon emission cost, and a production raw material cost as an object, and solving and obtaining an optimal operation mode of a joint regulation of the material flow-energy flow-carbon emission flow in the steel enterprise.

1 Claim, 10 Drawing Sheets

JOINT REGULATION METHOD OF MATERIAL FLOW, ENERGY FLOW, AND CARBON EMISSION FLOW IN LONG-PROCESS IRON AND STEEL ENTERPRISES

CROSS-REFERENCE TO RELATED APPLICATIONS

This application claims priority to Chinese Patent Application No. 202410668647.5, filed May 28, 2024, the entire contents of which are incorporated herein by reference.

TECHNICAL FIELD

The present disclosure relates to the field of intelligent regulation and control technology of electric power system in the steel industry, and in particular relates to a joint regulation method of material flow, energy flow, and carbon emission flow in a long-process steel enterprise.

BACKGROUND

The steel industry, as an energy-intensive mainstay, generates large amounts of carbon dioxide and other pollutant emissions. The steel industry is undergoing a low-carbon transition, which covers a wide range of aspects, including production structure, production raw materials, process technology, energy utilization, and carbon capture. While the traditional steel long-process production process has a large number of links, the enterprise's low-carbon transition has made the internal structure of the integrated energy system more complex and has brought great challenges to the production scheduling. With the improvement of industrial automation and the development of the Industrial Internet of Things (IoT), high-efficiency industrial load management and optimal scheduling have become a new trend.

At present, in the modeling of production scheduling in the steel industry, either only a material-energy characteristic model of a plurality of production processes of the steel enterprise is constructed, or only a carbon emission model of the steel enterprise is constructed. The coupling of two to construct a material flow-energy flow-carbon emission flow coupling model in the iron and steel enterprise is still lacking.

Therefore, it is hoped to propose a joint regulation method of material flow, energy flow, and carbon emission flow in a long-process steel enterprise, which efficiently couples a material-energy characteristic model and a carbon emission model of each production process in the steel enterprise and constructs a material flow-energy flow-carbon emission flow coupling model of the steel enterprise to jointly regulate the production process of steel production.

SUMMARY

This present disclosure provides a joint regulation method of material flow, energy flow, and carbon emission flow in a long-process steel enterprise, which is used to solve a technical problem of the steel industry in which a material-energy characteristic model of each production process is not coupled with a carbon emission model and a joint regulation is not performed.

One or more embodiments of the present disclosure provide a joint regulation method of material flow, energy flow, and carbon emission flow in a long-process steel enterprise, wherein the joint regulation of the material flow, energy flow, carbon emission flow is performed by constructing a plurality of models, production processes of the long-process steel enterprise include a coking process, a sintering process, a pelletizing process, a blast furnace iron-making process, a converter steel-making process, an electric arc furnace steel-making process, a steel-rolling process, and an air compressor oxygen-making process that provides oxygen in a corresponding process, and corresponding process numbers of the production processes are from 1 to 7 in sequence, wherein the coking process and an scrap electric arc furnace short-process steel-making process belong to an intermittent output process, the sintering process, the pelletizing process, the blast furnace iron-making process, the converter steel-making process, and the steel-rolling process belong to a continuous output process; and the air compressor oxygen-making process belongs to an auxiliary process; the method comprising following steps, the following steps being carried out in turn.

Step 1. constructing a material flow model of a short-process electric arc furnace steel-making process, wherein the material flow model of the short-process electric arc furnace steel-making process includes following constraints:

(1) constructing continuous constraint for starting and stopping of a short-process electric arc furnace steel-making production process:

$$ds_{6,t} + \mathrm{dc}_{6,t} \le 1, \tag{1}$$

$$ds_{6,t} - \mathrm{dc}_{6,t} = op_{6,t} - op_{6,t-1}, \tag{2}$$

wherein $\mathrm{ds}_{6,t}$ is a starting variable of the short-process electric arc furnace steel-making production process; $\mathrm{dc}_{6,t}$ is a stopping variable of the short-process electric arc furnace steel-making production process; $\mathrm{op}_{6,t}$ is a running variable of the short-process electric arc furnace steel-making production process; and 6 is a number of the short-process electric arc furnace steel-making production process;

(2) constructing a minimum running time constraint of the short-process electric arc furnace steel-making production process:

$$ds_{6,t} + \sum_{\tau=t+1}^{t+Minop_6-1} \mathrm{dc}_{6,\tau} \le 1, \tag{3}$$

wherein $\mathrm{Minop}_6$ is a minimum running time of the short-process electric arc furnace steel-making production process;

(3) constructing a maximum running time constraint of the short-process electric arc furnace steel-making production process:

$$\sum_{\tau=t}^{t+Maxop_6-1} \mathrm{dc}_{6,\tau} \ge ds_{6,t}, \tag{4}$$

wherein $\mathrm{Maxop}_6$ is a maximum running time of the short-process electric arc furnace steel-making production process;

(4) constructing a minimum downtime constraint of the short-process electric arc furnace steel-making production process:

$$dc_{6,t} + \sum_{\tau=t+1}^{t+Dp_{6,-1}} ds_{6,\tau} \le 1, \quad (5)$$

wherein $Dp_6$ is a minimum downtime of the short-process electric arc furnace steel-making production process;

(5) constructing a material flow constraint of the short-process electric arc furnace steel-making production process:

$$G_{6,t} = \sum_k op_{6,t} \cdot G_6, \quad (6)$$

wherein $G_{6,t}$ is a product output of the short-process electric arc furnace steel-making production process 6; and $G_6$ is a unit output of the short-process electric arc furnace steel-making production process 6;

step 2. constructing a material model of a long-process steel enterprise process:

(1) a constructing a material flow constraint model of a coking production process:

$$Y_{1,t} \times k = G_{1,t} \ \forall t, \quad (7)$$

$$G_{min1} \le G_{1,t} \le G_{max1} \ \forall t, \quad (8)$$

$$G_{1,t} \times \lambda_{jt2} = M_{jt2} \ \forall t, \quad (9)$$

$$G_{1,t} \times \lambda_{jt3} = M_{jt3} \ \forall t, \quad (10)$$

$$G_{1,t} \times \lambda_{jt4} = M_{jt4} \ \forall t, \quad (11)$$

wherein $Y_{1,t}$ is an input raw material quantity of a process 1, wherein the input raw material is coking coal; k is a coking ratio; $G_{1,t}$ is a product output of the process 1; $\lambda_{jt2}$ is a coke supply and demand ratio of a process 2; $\lambda_{jt2}$ is a coke supply and demand ratio of a process 3; $\lambda_{jt4}$ is a coke supply and demand ratio of a process 4; $M_{jt2}$ is a quantity of coke input into the process 2; $M_{jt3}$ is a quantity of coke input into the process 3; $M_{jt4}$ is a quantity of coke input into the process 4; $G_{min\ 1}$ and $G_{max\ 1}$ are an output lower limit and a output upper limit of the process 1, respectively;

(2) constructing a material flow constraint model of a sintering production process:

$$(M_{jt2} + Y_{2,t} \times \lambda_{tks2}) \times v_2 = G_{2,t} \ \forall t, \quad (12)$$

$$G_{min\ 2} \le G_{2,t} \le G_{max\ 2} \ \forall t, \quad (13)$$

$$G_{2,t} \times \lambda_{sjk4} = M_{sjk4} \ \forall t, \quad (14)$$

wherein $Y_{2,t}$ is an input raw material quantity of the process 2, wherein the input raw material is iron ore; $v_2$ is a material conversion rate of the process 2; $\lambda_{tks2}$ is an iron ore supply and demand ratio of the process 2; $G_{2,t}$ is a product output of the process 2; $\lambda_{sjk4}$ is an sinter ore supply and demand ratio of the process 4; $M_{sjk4}$ is a quantity of sinter ore input into the process 4, and $G_{min\ 2}$ and $G_{max\ 2}$ are an output lower limit and an output upper limit of the process 2, respectively;

(3) constructing a material flow constraint model of a pelletizing production process:

$$(M_{jt3} + Y_{2,t} \times \lambda_{tks3}) \times v_3 = G_{3,t} \ \forall t, \quad (15)$$

$$G_{min3} \le G_{3,t} \le G_{max\ 3} \ \forall t, \quad (16)$$

$$G_{3,t} \times \lambda_{qtk4} = M_{qtk4} \ \forall t, \quad (17)$$

wherein $v_3$ is a material conversion rate of the process 3; $G_{3,t}$ is a product output of the process 3; $\lambda_{tks3}$ is an iron ore supply and demand ratio of the process 3; $\lambda_{qtk4}$ is a pellet ore supply and demand ratio of the process 4; $M_{qtk4}$ is a quantity of pellet ore input into the process 4; $G_{min\ 3}$ and $G_{max\ 3}$ are an output lower limit and an output upper limit of the process 3, respectively;

(4) constructing a material flow constraint model of a blast furnace iron-making production process:

$$(M_{jt4} + M_{sjk4} + M_{qtk4}) \times v_4 = G_{4,t} \ \forall t, \quad (18)$$

$$G_{min4} \le G_{4,t} \le G_{max\ 4} \ \forall t, \quad (19)$$

wherein $v_4$ is a material conversion rate of the process 4; $G_{4,t}$ is a product output of the process 4; $G_{min\ 4}$ and $G_{max\ 4}$ are an output lower limit and an output upper limit of the process 4, respectively;

(5) constructing a material flow constraint model of a converter steel-making production process:

$$G_{4,t} \times v_5 = G_{5,t} \ \forall t, \quad (20)$$

$$G_{min5} \le G_{5,t} \le G_{max\ 5} \ \forall t, \quad (21)$$

wherein $v_5$ is a material conversion rate of a process 5; $G_{5,t}$ is a product output of the process 5; $G_{min\ 5}$ and $G_{max\ 5}$ are an output lower limit and an output upper limit of the process 5, respectively;

(6) constructing a material flow constraint model of a steel-rolling production process:

$$(G_{5,t} + G_{6,t}) \times v_7 = G_{7,t} \ \forall t, \quad (22)$$

$$G_{min7} \le G_{7,t} \le G_{max\ 7} \ \forall t, \quad (23)$$

wherein $v_7$ is a material conversion rate of a process 7; $G_{7,t}$ is a product output of the process 7; $G_{min\ 7}$ and $G_{max\ 7}$ are an output lower limit and an output upper limit of the process 7, respectively;

step 3. combining a plurality of constraints obtained in step 2 to construct three warehouse storage models, an air compression system model, a gas system model, a cogeneration unit model, and a coke dry quenching waste heat recovery model, the three warehouse storage models include a coke warehouse storage model, a sinter ore warehouse storage model, and a pellet ore warehouse storage model:

(1) constructing the warehouse storage models:

$$S_{0,c} + \sum_m M_{m,c,t} - \sum_n Y_{n,c,t} = S_{c,t}, \quad c \in \{1, 2, 3\}, m \in j, n \in j, t = 1, \quad (24)$$

$$S_{c,t-1} + \sum_m M_{m,c,t} - \sum_n Y_{n,c,t} = S_{c,t}, \quad c \in \{1, 2, 3\}, m \in j, n \in j, t \ge 2, \quad (25)$$

-continued $$S_{min,c} \le S_{c,t} \le S_{max,c} \quad c \in \{1, 2, 3\}, \ \forall t, \tag{26}$$

wherein Equations (24) and (25) are storage link balance equations; Equation (26) is an storage link upper and lower limit equation; c is a warehouse serial number; $S_{0,c}$ is an initial storage volume of a warehouse c; $M_{m,c,t}$ is an output of a previous mth process of the warehouse c at the time t; $Y_{n,c,t}$ is a material required for a following nth process of the warehouse c at the time t; $S_{c,t}$ is a capacity of the warehouse c at the time t; $S_{min,\ c}$ is an storage capacity lower limit of the warehouse c; and $S_{max,c}$ is an storage capacity upper limit of the warehouse c;

(2) constructing the air compression system model:

$$SA_{ca,t} = SA_{ca,t-1} - SU_{ca,t}\Delta t + \alpha_{ca}P_{ca,t}\Delta t, \tag{27}$$

$$0.8SA_{ca,ini} \le SA_{ca,end} \le 1.2SA_{ca,ini}, \tag{28}$$

$$V_{ca}p_{ca,min} \le SA_{ca,t} \le V_{ca}p_{ca,max}, \tag{29}$$

$$SA_{ca,t} + op_{ca,t}V_{ca}p_{ca,max} \le 1.1V_{ca}p_{ca,max}, \tag{30}$$

$$1.1V_{ca}p_{ca,max} \le SA_{ca,t} + op_{ca,t}V_{ca}p_{ca,min}, \tag{31}$$

wherein Equation (27) is an gas storage volume balance equation; Equations (28) and (29) are gas storage volume upper and lower limit equations; Equations (30) and (31) are air compressor starting and stopping equations; $SA_{ca,t}$ is a gas storage volume of a gas storage tank at the time t; $SU_{ca,t}$ is a system gas consumption at the time t; $\alpha_{ca}$ is an efficiency of an air compressor; $P_{ca,t}$ is an output power of the air compressor at the time t; $\Delta t$ is an optimization step size of 1 hour; $SA_{ca,ini}$ is a gas storage volume of the gas storage tank at an initial time; $SA_{ca,end}$ is a gas storage volume of the gas storage tank at an ending time; $V_{ca}$ is a volume of the gas storage tank; $p_{ca,min}$ and $p_{ca,max}$ are a allowable minimum pressure and a allowable maximum pressure in the gas storage tank; $op_{ca,t}$ is a running variable of the air compressor at the time t;

(3) constructing the gas system model:

$$f_{COG,t}^{prod} = \mu_{COG}P_{1,t}, \tag{32}$$

$$f_{BFG,t}^{prod} = \mu_{BFG}P_{4,t}, \tag{33}$$

$$f_{LDG,t}^{prod} = \mu_{LDG}P_{5,t}, \tag{34}$$

$$V_{o,t} = V_{o,t-1} + f_{o,t}^{prod} - \sum_j f_{j,o,t} - f_{o,t}^{chp}, \tag{35}$$

$$V_{min,o} \le V_{o,t} \le V_{max,o}, \tag{36}$$

wherein $\mu_{COG}$, $\mu_{BFG}$, $\mu_{LDG}$ are a by-product gas yield of coke oven gas (COG), a by-product gas yield of blast furnace gas (BFG), and a by-product gas yield of Linz-Donawitz process gas (LDG), respectively, and a gas output is proportional to a load of a corresponding production process; o is by-product gas; $V_{o,t}$ is the gas storage capacity;

$$f_{o,t}^{prod}$$

is the gas output; $f_{j,o,t}$ is a demand of the process j to the by-product gas o;

$$f_{o,t}^{chp}$$

is a volume of gas input into a cogeneration unit; $V_{min,o}$ and $V_{max,o}$ are a capacity lower limit and a capacity upper limit of a corresponding gas storage tank;

(4) constructing the cogeneration unit model:

$$P_t^{chp}\delta = \theta_{chp}\sum_o f_{o,t}^{chp}\beta_o, \tag{37}$$

$$P_{min}^{ch\rho} \le P_t^{chp} \le P_{max}^{chp}, \tag{38}$$

$$Q_t^{chp} = P_t^{chp}\theta_{chp,heat}, \tag{39}$$

wherein Equation (37) is a conversion formula for conversion of thermal energy to electrical energy, wherein the thermal energy is generated from the combustion of the by-product gas as a fuel in the cogeneration unit; Equation (38) is an upper and lower output limit constraint of the cogeneration unit; Equation (39) is a conversion formula for conversion of the electrical energy to the thermal energy in the cogeneration unit;

$$Q_t^{chp}$$

is steam heat generated by the cogeneration unit;

$$P_t^{chp}$$

is electric power of the cogeneration unit; $\delta$ is an optimized cycle length;

$$P_{min}^{chp} \text{ and } P_{max}^{chp}$$

are a lower output limit and an upper output limit of the cogeneration unit, respectively; $\theta_{chp}$ is an electrical efficiency of the cogeneration unit; $\theta_{chp,heat}$ is a thermal efficiency of the cogeneration unit; $\beta_o$ is a calorific value of the by-product gas o;

(5) constructing the coke dry quenching waste heat recovery model with a low carbon process:

$$P_t^{cdq} = \lambda_{cdq}P_{1,t}, \tag{40}$$

$$P_{min}^{cdq} \le P_t^{cdq} \le P_{max}^{cdq}, \tag{41}$$

wherein $$P_t^{cdq}$$

is a waste heat power generation power; $\lambda_{cdq}$ is a power generation coefficient; $P_{1,t}$ is a coking power;

$$P_{min}^{cdq} \text{ and } P_{max}^{cdq}$$

are a lower output limit and an upper output limit of a coke dry quenching waste heat unit, respectively;

step 4. introducing the short-process electric arc furnace steel-making production process as a low-carbon process into the material model of the long-process steel enterprise process to form a material-energy characteristic model of a long-process steel enterprise production process based on the warehouse storage model, the air compression system model, the gas system model, the cogeneration unit model, and the coke dry quenching waste heat recovery model, wherein the energy includes electrical energy, heat energy, and oxygen energy;

Constraints of the material-energy characteristic model of the long-process steel enterprise production process are as follows:

$$P_{total,t} = \sum_{j=1} G_{j,t} \cdot P_j \quad \forall t, \forall j \in \{1, 2, 3, 4, 5, 6, 7\}, \tag{42}$$

$$P_t^{pv} + P_t^{chp} + P_t^{grid} + P_t^{cdq} = P_{ca,t} + P_{total,t} + P_{load}, \tag{43}$$

$$V_{o,t} = V_{o,t-1} + f_{o,t}^{prod} - \sum_j f_{j,o,t} - f_{o,t}^{chp}, \tag{44}$$

$$Q_t^{chp} = \sum_{j=1} G_{j,t} \cdot Q_j + H_{load} \quad \forall t, \forall j \in \{1, 2, 3, 4, 5, 6, 7\}, \tag{45}$$

$$P_{ca,t} \cdot \psi_{ca} = \sum_{j=1} G_{j,t} \cdot A_j \quad \forall t, \forall j \in \{1, 2, 3, 4, 5, 6, 7\}, \tag{46}$$

$$G_{7,t} \le F_{sum,task}, \tag{47}$$

wherein Equations (42) and (43) are active power balance constraints; Equation (44) is a gas energy balance constraint; Equation (45) is a heat energy balance constraint; Equation (46) is a compressed air energy balance constraint; and Equation (47) is a total production task constraint; $G_{j,t}$ is an output of the production process j, and j∈{1,2,3,4,5,6,7}; $P_{total,t}$ is a total production load of the process; $P_j$ is an unit production fixed load of the production process j∈{1,2,3,4,5,6,7};

$$P_t^{pv}$$

is a photovoltaic output power;

$$P_t^{chp}$$

is an output power of the cogeneration unit;

$$P_t^{grid}$$

is a power of electricity purchased from the higher grid; $P_{load}$ is a rest electrical load of enterprise operation; $Q_j$ is thermal energy required for the production process j, j∈{1,2,3,4,5,6,7}; $H_{load}$ is a rest thermal load of enterprise operation; $\psi_{ca}$ is an efficiency of conversion of electrical energy into gas energy; $A_j$ is a unit gas consumption of the production process j, j∈{1,2,3,4,5,6,7}; $F_{sum,task}$ is a total task volume of the processes;

step 5. constructing a carbon emission model of a steel enterprise, wherein the carbon emission model of the steel enterprise includes: an indirect carbon emission model of purchased electricity consumption, a direct carbon emission model of coke consumption, a carbon emission model of a production process after attribution, and a carbon emission model of the by-product gas;

(1) constructing the indirect carbon emission model of the purchased electricity consumption:

$$E_{carbon}^{grid,t} = \rho_{elec,t} P_t^{grid}, \tag{48}$$

wherein $$E_{carbon}^{grid,t}$$

is a carbon emission of purchased electricity; $\rho_{elec,t}$ is a carbon content coefficient of the purchased electricity;

(2) constructing the direct carbon emission model of the coke consumption:

$$E_{carbon}^{coke,t} = \rho_{coke} F_t^{coke}, \tag{49}$$

wherein $$E_{carbon}^{coke,t}$$

is a carbon emission of coke; $\rho_{coke}$ is a carbon content coefficient of the coke;

$$F_t^{coke}$$

is coke consumption;

(3) constructing the carbon emission model of the production process after the attribution:

$$E_{carbon}^{y,t} = \sum_{j=1} G_{j,t} \cdot \rho_j \quad \forall t, \forall j \in \{1, 2, 3, 4, 5, 6, 7\}, \tag{50}$$

wherein $$E_{carbon}^{y,t}$$

is a total carbon emission of the production process; $\rho_j$ is a fixed carbon emission coefficient of the production process j;

(4) constructing the carbon emission model of the by-product gas:

$$E_{carbon}^{gas,t} = \sum_o \rho_o^{gas}\left(\sum_j f_{j,o,t} + f_{o,t}^{chp}\right) - \sum_o \rho_o^{gas} f_{o,t}^{prod}, \quad (51)$$

wherein $$E_{carbon}^{gas,t}$$

is a carbon emission or emission of the by-product gas;

$$\rho_o^{gas}$$

is a carbon content coefficient of the by-product gas;

(5) constructing a total carbon emission model of the steel enterprise:

$$E_{carbon}^{total,t} = E_{carbon}^{grid,t} + E_{carbon}^{gas,t} + E_{carbon}^{coke,t} + E_{carbon}^{y,t}, \quad (52)$$

wherein $$E_{carbon}^{total,t}$$

is a total carbon emission of the steel enterprise;

wherein the carbon emission coefficient used in the production process of the steel enterprise is set by referring to actual data from a real long-process steel enterprise;

step 6: constructing a material flow-energy flow-carbon emission flow coupling model of the long-process steel enterprise, establishing an objective function using a minimize sum of an electricity purchase cost from a superior grid, a park carbon emission cost, and a production raw material cost as an object, and solving and obtaining an optimal operation mode of the joint regulation of the material flow-energy flow-carbon emission flow in the long-process steel enterprise to realize the joint regulation of the material flow-energy flow-carbon emission flow in the long-process steel enterprise;

wherein the objective function is:

$$C_{min} = \sum_t P_t^{grid} \cdot C_{gird,t} \sum_t \left(E_{carbon}^{total,t} - E_{pei,t}\right) \cdot C_{carbon} + \sum_t Y_{1,t} \cdot C_{ljm} + \sum_t Y_{2,t} \cdot C_{tks} + \sum_t Y_{3,t} \cdot C_{fg}, \quad (53)$$

wherein $C_{min}$ denotes a minimum sum of the electricity purchase cost from the superior grid, the park carbon emission cost, and the production raw material cost; $C_{gird,t}$ is a time-sharing electricity price, $E_{pei,t}$ is a free carbon emission allowance; $C_{carbon}$ is a fixed carbon price; $C_{ljm}$ is an unit ton price of production raw material 1, which is the unit ton price of the coking coal; $C_{tks}$ is an unit ton price of production raw material 2, which is the unit ton price of the iron ore; $C_{fg}$ is an unit ton price of production raw material 3, which is the unit ton price of scrap steel.

BRIEF DESCRIPTION OF THE DRAWINGS

The present disclosure is further described below in connection with the accompanying drawings and specific embodiments.

DETAILED DESCRIPTION

In order to make the objects, technical solutions, and advantages of the present disclosure clearer, embodiments of the present disclosure are described in further detail below.

It should be understood that the terms "system", "device", "unit," and/or "module" as used herein are methods for distinguishing between different components, elements, parts, sections, or assemblies at different levels. These words may be replaced by other expressions if other words accomplish the same purpose.

Unless the context clearly suggests an exception, the words "one", "a", and/or "the" do not refer specifically to the singular, but may also include the plural. In general, the terms "including" and "comprising" only suggest the inclusion of explicitly identified steps and elements that do not constitute an exclusive list, and the method or apparatus may also include other steps or elements.

When describing the operations performed in the embodiments of the present disclosure in terms of steps, the order of the steps is interchangeable unless otherwise indicated, the steps may be omitted, and other steps may be included in the process of operation.

In some embodiments, the steel enterprise may be configured with a processor, a storage device, or the like. The processor may be used to perform a joint regulation method of material flow, energy flow, and carbon emission flow in a long-process steel enterprise. The processor may include a central processing unit (CPU), an application-specific integrated circuit (ASIC), an application-specific instruction set processor (ASIP), an image processing unit (GPU), a physical operations processing unit (PPU), a digital signal processor (DSP), a field-programmable gate array (FPGA), a programmable logic device (PLD), a microprocessor, etc., or any combination thereof.

The storage device may store a variety of data from the production process, such as output rates, costs, carbon emissions, or the like. In some embodiments, the storage device may include a mass memory, a removable memory, etc., or any combination thereof.

Figure 1:
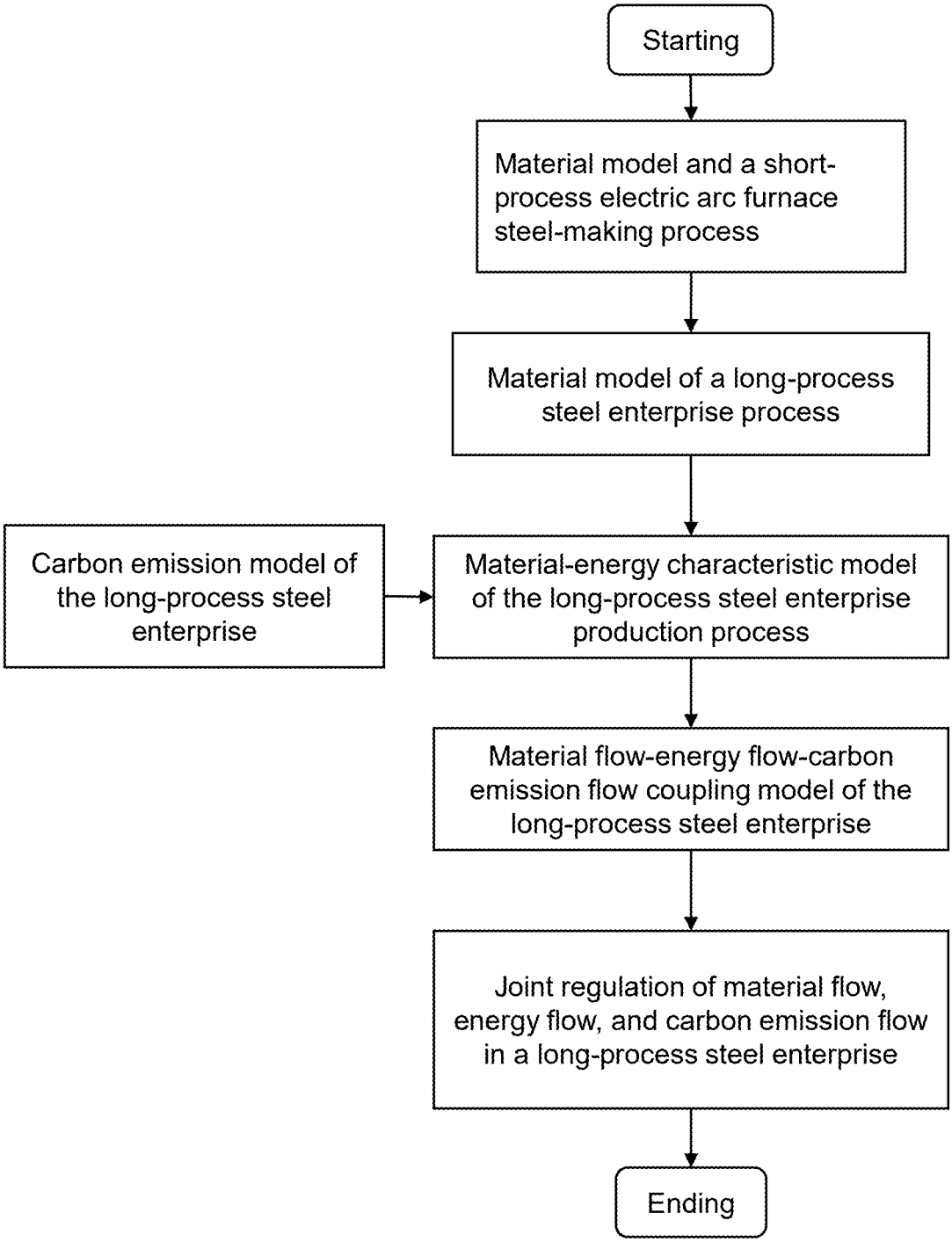
FIG. 1 is a flowchart of a joint regulation method of material flow, energy flow, and carbon emission flow in a long-process steel enterprise according to some embodiments of the present disclosure.

FIG. 1 is a flowchart of a joint regulation method of material flow, energy flow, and carbon emission flow in a long-process steel enterprise according to some embodiments of the present disclosure.

The present disclosure provides a joint regulation method of material flow, energy flow, and carbon emission flow in a long-process steel enterprise, and the method is executed through a processor. As shown in FIG. 1, the method includes the following steps.

In some embodiments, an overview of the energy use framework of a long-process steel enterprise is provided to introduce a plurality of industrial production processes of a steel enterprise using a task volume of 28,000 tons of steel delivered in a day as an example. For example, industrial production processes include processes such as product production and product storage, and categories of production processes include a continuous process (also referred to as a continuous output process), a discrete process (also referred to as an intermittent output process), etc. Simultaneously, a material model and a short-process electric arc furnace steel-making process are incorporated as measures for low-carbon process. The short-process electric arc furnace steel-making process may also be referred to as a short-process electric arc furnace steel-making production process or an electric arc furnace steel-making process.

In some embodiments, the processor may introduce the material model and the short-process electric arc furnace steel-making process into a steel-making process of the steel enterprise to form a material model of a long-process steel enterprise process based on a continuous constraint for starting and stopping of the short-process electric arc furnace steel-making production process, a minimum running time constraint, a maximum running time constraint and a minimum downtime constraint of the short-process electric arc furnace steel-making production process, and a principle of conservation of steel-making material during the entire process of the short-process electric arc furnace steel-making production process.

In some embodiments, the processor may construct a warehouse storage model, an air compression system model, a gas system model, a cogeneration unit model, and a coke dry quenching waste heat recovery model, etc. based on the above constraints on the energy-use characteristics of the long-process steel enterprise.

In some embodiments, the processor may construct a carbon emission model of the long-process steel enterprise based on a carbon emission source framework of the long-process steel enterprise and couple a material-energy characteristic model of the long-process steel enterprise production process with the carbon emission model of the long-process steel enterprise to obtain a material flow-energy flow-carbon emission flow coupling model of the long-process steel enterprise. The processor may also minimize the sum of an electricity purchase cost from a superior grid, a park carbon emission cost, and a production raw material cost, perform a joint regulation of the material flow-energy flow-carbon emission flow in the long-process steel enterprise, and solve the material flow-energy flow-carbon emission flow coupling model of the long-process steel enterprise to obtain an optimal operation mode of the joint regulation of the material flow-energy flow-carbon emission flow in the long-process steel enterprise.

The embodiment of this present disclosure can more accurately obtain the optimal plan for the production and operation of the steel enterprise through the above steps, improve the economic and energy efficiency utilization of the production system, realize low-carbon operation, and facilitate the subsequent study of the long-process steel enterprise and the electric carbon market.

The above embodiments are described in detail below in connection with specific examples, as described below.

Figure 2:
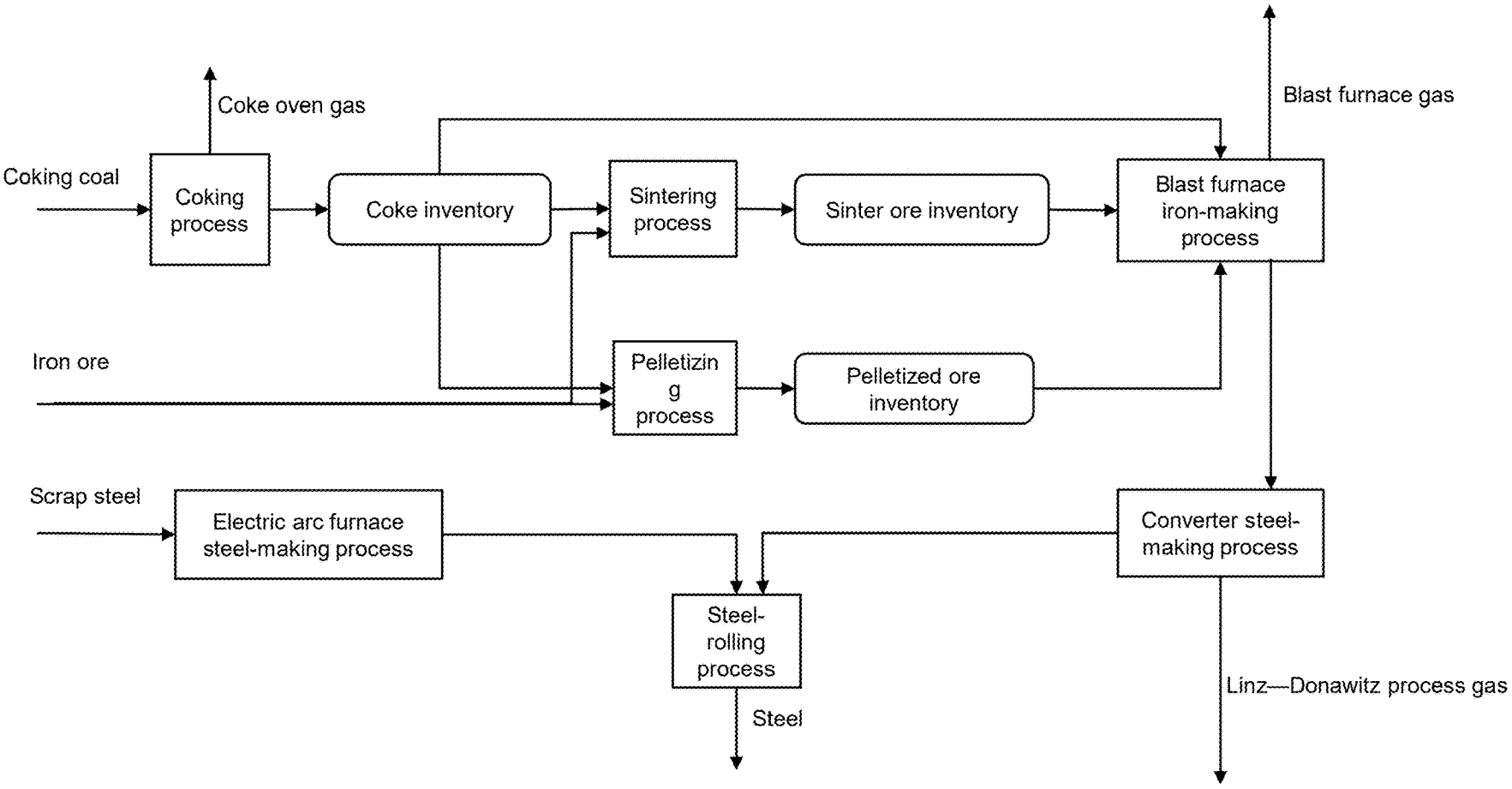
FIG. 2 is a schematic diagram of a production process model of the long-process steel enterprise according to some embodiments of the present disclosure.
Figure 3:
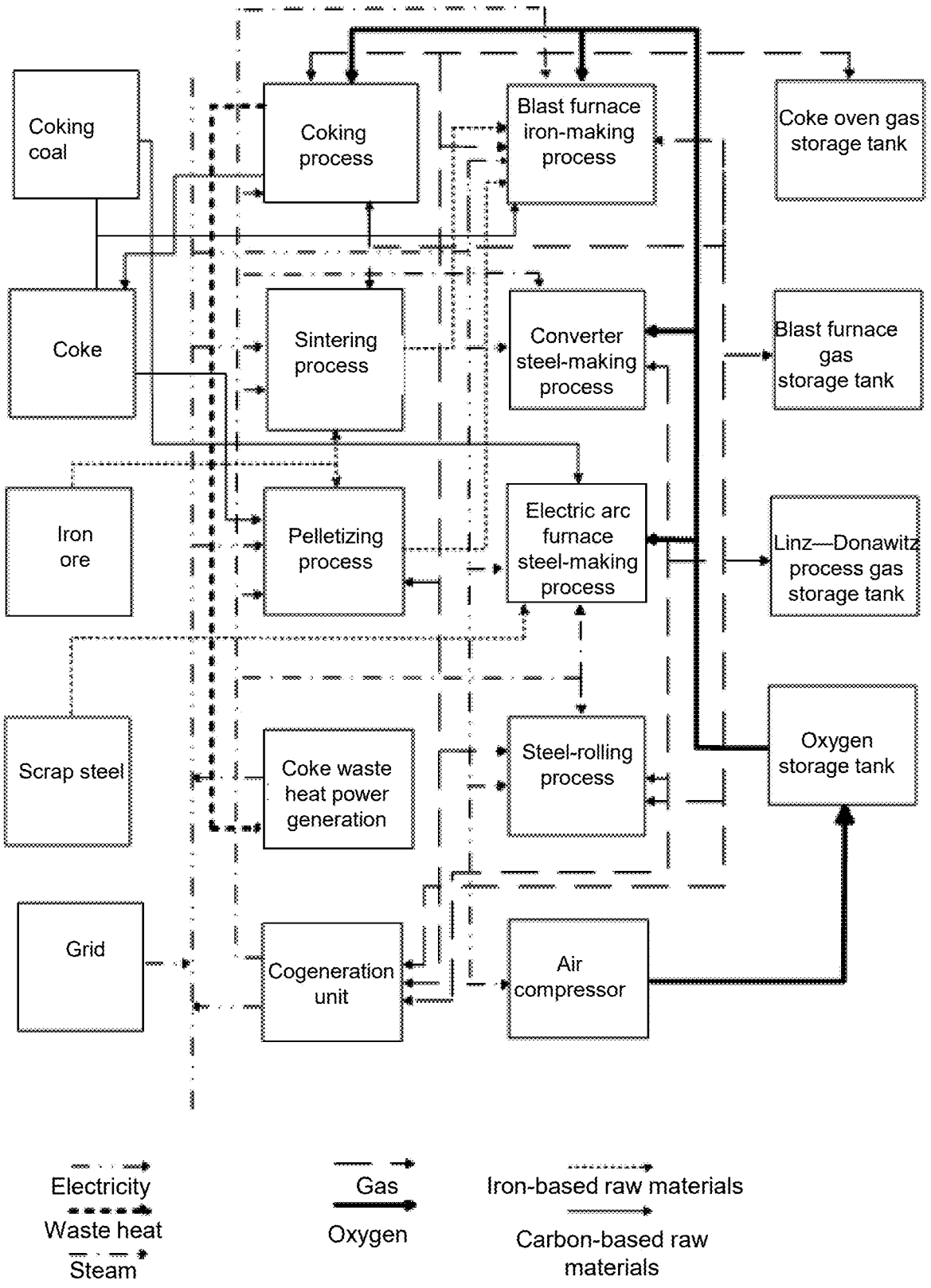
FIG. 3 is a schematic diagram of an energy use framework model of the long-process steel enterprise according to some embodiments of the present disclosure.

FIG. 2 is a schematic diagram of a production process model of the long-process steel enterprise according to some embodiments of the present disclosure. FIG. 3 is a schematic diagram of an energy use framework model of the long-process steel enterprise according to some embodiments of the present disclosure.

In some embodiments, as shown in FIG. 2 and FIG. 3, the long-process steel enterprise production process may be represented by a long-process steel enterprise production process model, including a coking process, a sintering process, a pelletizing process, a blast furnace iron-making process, a converter steel-making process, an electric arc furnace steel-making process, a steel-rolling process, and an air compressor oxygen-making process that provides oxygen in a corresponding process, and corresponding process numbers of the production processes are from 1 to 7 in sequence.

(1) The Coking Process

In some embodiments, the calculation range of the coking process may start with the entry of raw material coking coal, electricity, oxygen, etc. into the coking branch plant, and end with the output of products, including coke, coke oven gas, and co-products such as tar and steam, etc. The coke may be stored in the coke warehouse, and subsequent processes that need to use coke may obtain coke through the coke inventory in the coke warehouse.

(2) The Sintering Process

In some embodiments, the calculation range of the sintering process may start with the entry of iron ore, coke, blast furnace gas, or the like into the sintering branch plant, and end with the output of products, including sinter ore, etc. The sinter ore may be stored in a sinter ore warehouse, and subsequent processes requiring the use of sinter ore may obtain the sinter ore through the sinter ore inventory in the sinter ore warehouse.

(3) The Pelletizing Process

In some embodiments, the calculation range of the pelletizing process may start with the entry of raw material iron ore, coke, blast furnace gas, coke oven gas, or the like into the pelletizing branch plant, and end with the output of products, including pelletized ore, etc. The pelletized ore may be stored in a pellet ore warehouse, and subsequent processes requiring the use of the pelletized ore may obtain the pelletized ore through the pelletized ore inventory in the pellet ore warehouse.

(4) The Blast Furnace Iron-Making Process

In some embodiments, the calculation range of the blast furnace iron-making process may start with the entry of raw material sinter ore, pellet ore, electric power, oxygen, steam, or the like into the blast furnace iron-making branch plant, and end with the output of products, including molten iron, externally supplied blast furnace gas, or the like. The externally supplied blast furnace gas refers to a gas produced by the blast furnace and supplied to devices or processes outside of steel production.

(5) The Converter Steel-Making Process

In some embodiments, the calculation range of the converter steel-making process may start with the entry of raw material 100% molten iron, by-product gas, oxygen, electricity, etc. into the steel-making shop, and end with the output of products, including billets, externally supplied Linz-Donawitz process gas (LDG), steam, or the like. The externally supplied LDG refers to a gas produced by the converter and supplied to equipment or processes outside of steel production.

(6) The Electric Arc Furnace Steel-Making Process

In some embodiments, the calculation range of the electric arc furnace steel-making process may start with the entry of raw materials 100% scrap steel, by-product gas, oxygen, electricity, etc. into the electric arc furnace shop, and end with the output of products, including billets, or the like. The by-product gas refers to a gas that is a by-product of the process of producing steel.

The electric arc furnace steel-making process is a more mature low-carbon metallurgical process, the raw material may be scrap steel, and molten steel is directly produced through the melting of the scrap steel and the removal of impurities. Because the electric arc furnace steel-making process has a very low demand for coke and other raw materials, but a higher electricity demand, the introduction of the electric arc furnace steel-making process into the long-process steel enterprise production process reduces the output and production load of the coking process, the sintering process, the pelletizing process, etc., and subsequently reduce a production amount of a plurality of types of the by-product gas, thereby reducing carbon emissions of steel enterprises.

(7) The Steel-Rolling Process

In some embodiments, the calculation range of the steel-rolling process may start with the entry of raw material billets, by-product gas, electricity, etc. into the steel-rolling shop and end with the output product, including finished rolled steel (i.e., steel), or the like.

(8) The Air Compressor Oxygen-Making Process

In some embodiments, an air compressor may provide the oxygen required for a plurality of processes described above.

In some embodiments, the processor may categorize the plurality of processes described above, the coking process and the scrap electric arc furnace short-process steel-making process (i.e., the electric arc furnace steel-making process) belong to intermittent output processes. The sintering process, the pelletizing process, the blast furnace iron-making process, the converter steel-making process, and the steel-rolling process belong to continuous output processes. The air compressor oxygen-making process belong to an auxiliary process.

In some embodiments of the present disclosure, the short-process electric arc furnace steel-making production process as a low-carbon process measure is introduced into the long-process steel enterprise production process model to form the material model of the long-process steel enterprise process based on the continuous constraint for starting and stopping, the minimum running time constraint, the maximum running time constraint, the minimum downtime constraint, and a material flow constraint of the short-process electric arc furnace steel-making production process.

In some embodiments, the joint regulation method of material flow, energy flow, and carbon emission flow in a long-process steel enterprise includes the following steps, and the following steps are performed in sequence.

Step 1. constructing a material flow model of a short-process electric arc furnace steel-making process, wherein the material flow model of the short-process electric arc furnace steel-making process includes following constraints.

(1) constructing a continuous constraint for starting and stopping of the short-process electric arc furnace steel-making production process:

$$ds_{6,t} + dc_{6,t} \leq 1, \tag{1}$$

$$ds_{6,t} - dc_{6,t} = op_{6,t} - op_{6,t-1}. \tag{2}$$

Wherein $ds_{6,t}$ is a starting variable of the short-process electric arc furnace steel-making production process, $dc_{6,t}$ is a stopping variable of the short-process electric arc furnace steel-making production process, $op_{6,t}$ is a running variable of the short-process electric arc furnace steel-making production process, and 6 is a number of the short-process electric arc furnace steel-making production process, t is a current time period (e.g., 1 day, etc.), and t−1 is a previous time period.

(2) constructing a minimum running time constraint of a short-process electric arc furnace steel-making production process:

$$ds_{6,t} + \sum_{\tau=t+1}^{t+Minop_6-1} dc_{6,\tau} \leq 1. \tag{3}$$

Wherein $Minop_6$ is a minimum running time of the short-process electric arc furnace steel-making production process, t+1 is a next time period.

(3) constructing a maximum running time constraint of the short-process electric arc furnace steel-making production process:

$$\sum_{\tau=t}^{t+Maxop_6-1} dc_{6,\tau} \geq ds_{6,t}. \tag{4}$$

Wherein $Maxop_6$ is a maximum running time of the short-process electric arc furnace steel-making production process.

(4) constructing a minimum downtime constraint of the short-process electric arc furnace steel-making production process:

$$dc_{6,t} + \sum_{\tau=t+1}^{t+Dp_6-1} ds_{6,\tau} \leq 1. \tag{5}$$

Wherein $Dp_6$ is a minimum downtime of the short-process electric arc furnace steel-making production process.

(5) constructing a material flow constraint of the short-process electric arc furnace steel-making production process:

$$G_{6,t} = \sum_t op_{6,t} \cdot G_6. \tag{6}$$

Wherein $G_{6,t}$ is a product output of the short-process electric arc furnace steel-making production process 6, and $G_6$ is a unit output of the short-process electric arc furnace steel-making production process 6.

Step 2: constructing a material model of a long-process steel enterprise process.

(1) constructing a material flow constraint model of a coking production process:

$$Y_{1,t} \times k = G_{1,t} \quad \forall t, \tag{7}$$

$$G_{min\ 1} \le G_{1,t} \le G_{max\ 1} \quad \forall t, \tag{8}$$

$$G_{1,t} \times \lambda_{jt2} = M_{jt2} \quad \forall t, \tag{9}$$

$$G_{1,t} \times \lambda_{jt3} = M_{jt3} \quad \forall t, \tag{10}$$

$$G_{1,t} \times \lambda_{jt4} = M_{jt4} \quad \forall t. \tag{11}$$

Wherein $Y_{1,t}$ is an input raw material quantity of a process 1 (i.e., a coking process), wherein the input raw material is coking coal, k is a coking ratio, $G_{1,t}$ is a product output of the process 1, $\lambda_{jt2}$ is a coke supply and demand ratio of a process 2, $\lambda_{jt2}$ is a coke supply and demand ratio of a process 3, $\lambda_{jt4}$ is a coke supply and demand ratio of a process 4, $M_{jt2}$ is a quantity of coke input into the process 2, $M_{jt3}$ is a quantity of coke input into the process 3, $M_{jt4}$ is a quantity of coke input into the process 4, $G_{min\ 1}$ and $G_{max\ 1}$ are an output lower limit and a output upper limit of the process 1, respectively. The coke supply and demand ratio refers to a ratio of a demanded quantity of coke to an output of coke.

(2) constructing a material flow constraint model of a sintering production process:

$$(M_{jt2} + Y_{2,t} \times \lambda_{tks2}) \times v_2 = G_{2,t} \quad \forall t \tag{12}$$

$$G_{min\ 2} \le G_{2,t} \le G_{max\ 2} \quad \forall t, \tag{13}$$

$$G_{2,t} \times \lambda_{sjk4} \le M_{sjk4} \quad \forall t. \tag{14}$$

Wherein $Y_{2,t}$ is an input raw material quantity of the process 2 (i.e., a sintering process), wherein the input raw material is iron ore, $v_2$ is a material conversion rate of the process 2, $\lambda_{tks2}$ is an iron ore supply and demand ratio of the process 2, $G_{2,t}$ is a product output of the process 2, $\lambda_{sjk4}$ is an sinter ore supply and demand ratio of the process 4, $M_{sjk4}$ is a quantity of sinter ore input into the process 4, and $G_{min\ 2}$ and $G_{max\ 2}$ are an output lower limit and an output upper limit of the process 2, respectively. The sinter ore supply and demand ratio refers to a ratio of a demand quantity of sinter ore to an output of sinter ore.

The material conversion rate refers to a rate of a quantity of output to a quantity of input raw material. The iron ore supply and demand ratio refers to a ratio of a demand quantity of iron ore to an input of iron ore.

(3) constructing a material flow constraint model of a pelletizing production process:

$$(M_{jt3} + Y_{2,t} \times \lambda_{tks3}) \times v_3 = G_{3,t} \quad \forall t, \tag{15}$$

$$G_{min\ 3} \le G_{3,t} \le G_{max\ 3} \quad \forall t, \tag{16}$$

$$G_{3,t} \times \lambda_{qtk4} \le M_{qtk4} \quad \forall t. \tag{17}$$

Wherein $v_3$ is a material conversion rate of the process 3 (i.e., a pelletizing process), $G_{3,t}$ is a product output of the process 3, $\lambda_{tks3}$ is an iron ore supply and demand ratio of the process 3, $\lambda_{qtk4}$ is a pellet ore supply and demand ratio of the process 4, $M_{qtk4}$ is a quantity of pellet ore input into the process 4, $G_{min\ 3}$ and $G_{max\ 3}$ are an output lower limit and an output upper limit of the process 3, respectively. The pellet ore supply and demand ratio refers to a ratio of a demand quantity of pellet ore to an output of pellet ore.

(4) constructing a material flow constraint model of a blast furnace iron-making production process:

$$(M_{jt4} + M_{sjk4} + M_{qtk4}) \times v_4 = G_{4,t} \quad \forall t, \tag{18}$$

$$G_{min\ 4} \le G_{4,t} \le G_{max\ 4} \quad \forall t. \tag{19}$$

Wherein $v_4$ is a material conversion rate of the process 4 (i.e., a blast furnace iron-making process), $G_{4,t}$ is a product output of the process 4, $G_{min\ 4}$ and $G_{max\ 4}$ are an output lower limit and an output upper limit of the process 4, respectively.

(5) constructing a material flow constraint model of a converter steel-making production process:

$$G_{4,t} \times v_5 = G_{5,t} \quad \forall t, \tag{20}$$

$$G_{min\ 5} \le G_{5,t} \le G_{max\ 5} \quad \forall t. \tag{21}$$

Wherein $v_5$ is a material conversion rate of a process 5 (i.e., a converter steel-making process), $G_{5,t}$ is a product output of the process 5, $G_{min\ 5}$ and $G_{max\ 5}$ are an output lower limit and an output upper limit of the process 5, respectively.

(6) constructing a material flow constraint model of a steel-rolling production process:

$$(G_{5,t} + G_{6,t}) \times v_7 = G_{7,t} \quad \forall t, \tag{22}$$

$$G_{min\ 7} \le G_{7,t} \le G_{max\ 7} \quad \forall t. \tag{23}$$

Wherein $v_7$ is a material conversion rate of a process 7 (i.e., a steel-rolling process), $G_{7,t}$ is a product output of the process 7, $G_{min\ 7}$ and $G_{max\ 7}$ are an output lower limit and an output upper limit of the process 7, respectively.

Step 3, combining a plurality of constraints obtained instep 2 to construct three warehouse storage models, an air compression system model, a gas system model, a cogeneration unit model, and a coke dry quenching waste heat recovery model.

(1) constructing the warehouse storage models:

$$S_{0,c} + \sum_m M_{m,c,t} - \sum_n Y_{n,c,t} = S_{c,t},\ c \in \{1,2,3\},\ m \in j,\ n \in j,\ t = 1, \tag{24}$$

$$S_{c,t-1} + \sum_m M_{m,c,t} - \sum_n Y_{n,c,t} = S_{c,t},\ c \in \{1,2,3\},\ m \in j,\ n \in j,\ t \ge 2, \tag{25}$$

$$S_{min,c} \le S_{c,t} \le S_{max,c} \quad c \in \{1,2,3\},\ \forall t. \tag{26}$$

Wherein Equations (24) and (25) are storage link balance equations, Equation (26) is an storage link upper and lower limit equation, c is a warehouse serial number, $S_{0,c}$ is an initial storage volume of a warehouse c, $M_{m,c,t}$ is an output of a previous mth process of the warehouse c at the time t, $Y_{n,c,t}$ is a material required for a following nth process of the warehouse c at the time t, $S_{c,t}$ is a capacity of the warehouse c at the time t, $S_{min,\ c}$ is an storage capacity lower limit of the warehouse c, and $S_{max,\ c}$ is an storage capacity upper limit of the warehouse c.

In some embodiments, the three warehouse storage models include a coke warehouse storage model, a sinter ore warehouse storage model, and a pellet ore warehouse storage model.

(2) constructing the air compression system model:

$$SA_{ca,t} = SA_{ca,t-1} - SU_{ca,t}\Delta t + \alpha_{ca}P_{ca,t}\Delta t, \quad (27)$$

$$0.8SA_{ca,ini} \le SA_{ca,end} \le 1.2SA_{ca,ini}, \quad (28)$$

$$V_{ca}p_{ca,min} \le SA_{ca,t} \le V_{ca}p_{ca,max}, \quad (29)$$

$$SA_{ca,t} + op_{ca,t}V_{ca}p_{ca,max} \le 1.1V_{ca}p_{ca,max}, \quad (30)$$

$$1.1V_{ca}p_{ca,max} \le SA_{ca,t} + op_{ca,t}V_{ca}p_{ca,min}. \quad (31)$$

Wherein Equation (27) is a gas storage volume balance equation, Equations (28) and (29) are gas storage volume upper and lower limit equations, Equations (30) and (31) are air compressor starting and stopping equations, $SA_{ca,t}$ is a gas storage volume of a gas storage tank at the time t, $SU_{ca,t}$ is a system gas consumption at the time t, $\alpha_{ca}$ is an efficiency of an air compressor, $P_{ca,t}$ is an output power of the air compressor at the time t, $\Delta t$ is an optimization step size of 1 hour, $SA_{ca,ini}$ is a gas storage volume of the gas storage tank at an initial time, $SA_{ca,end}$ is a gas storage volume of the gas storage tank at an ending time, $V_{ca}$ is a volume of the gas storage tank, $p_{ca,min}$ and $p_{ca,max}$ are a allowable minimum pressure and a allowable maximum pressure in the gas storage tank, $op_{ca,t}$ is a running variable of the air compressor at the time t.

(3) constructing the gas system model:

$$f_{COG,t}^{prod} = \mu_{COG}P_{1,t}, \quad (32)$$

$$f_{BFG,t}^{prod} = \mu_{BFG}P_{4,t}, \quad (33)$$

$$f_{LDG,t}^{prod} = \mu_{LDG}P_{5,t}, \quad (34)$$

$$V_{o,t} = V_{o,t-1} + f_{o,t}^{prod} - \sum_j f_{j,o,t} - f_{o,t}^{chp}, \quad (35)$$

$$V_{min,o} \le V_{o,t} \le V_{max,o}. \quad (36)$$

Wherein $\mu_{COG}$, $\mu_{BFG}$, $\mu_{LDG}$ are a by-product gas yield of coke oven gas (COG), a by-product gas yield of blast furnace gas (BFG), and a by-product gas yield of Linz-Donawitz process gas (LDG), respectively, and a gas output is proportional to a load of a corresponding production process.

$$f_{COG}^{prod}$$

is a production quantity or the coke oven gas, $$f_{BFG}^{prod}$$

is a production quantity of the blast furnace gas, and $$f_{LGD}^{prod}$$

is a production quantity of the Linz-Donawitz process gas. $P_{1,t}$ is a coking power, $P_{4,t}$ is a blast furnace iron-making power, and $P_{5,t}$ is a converter steel-making power. o is by-product gas, $V_{o,t}$ is the gas storage capacity, $$f_{o,t}^{prod}$$

is the gas output, $f_{j,o,t}$ is a demand of the process j to the by-product gas o, $$f_{o,t}^{chp}$$

is a volume or gas input into a cogeneration unit, $V_{min,o}$ and $V_{max,o}$ are a capacity lower limit and a capacity upper limit of a corresponding gas storage tank.

(4) constructing the cogeneration unit model:

$$P_t^{chp}\delta = \theta_{chp}\sum_o f_{o,t}^{chp}\beta_o, \quad (37)$$

$$P_{min}^{chp} \le P_t^{chp} \le P_{max}^{chp}, \quad (38)$$

$$Q_t^{chp} = P_t^{chp}\theta_{chp,heat}. \quad (39)$$

Wherein Equation (37) is a conversion formula for conversion of thermal energy to electrical energy, wherein the thermal energy is generated from the combustion of the by-product gas as a fuel in the cogeneration unit, Equation (38) is an upper and lower output limit constraint of the cogeneration unit, Equation (39) is a conversion formula for conversion of the electrical energy to the thermal energy in the cogeneration unit, $$Q_t^{chp}$$

is steam heat generated by the cogeneration unit, $$P_t^{chp}$$

is electric power of the cogeneration unit, $\delta$ is an optimized cycle length. The optimized cycle length refers to a period during which a heat energy of a cogeneration unit burned with the by-product gas as fuel is converted to an electrical energy.

$$P_{min}^{chp} \text{ and } P_{max}^{chp}$$

are a lower output limit and an upper output limit of the cogeneration unit, respectively, $\theta_{chp}$ is an electrical efficiency of the cogeneration unit, $\theta_{chp,\ heat}$ is a thermal efficiency of the cogeneration unit, $\beta_o$ is a calorific value of the by-product gas o.

(5) constructing the coke dry quenching waste heat recovery model with a low carbon process:

$$P_t^{cdq} = \lambda_{cdq}P_{1,t}, \quad (40)$$

-continued $$P_{min}^{cdq} \le P_t^{cdq} \le P_{max}^{cdq}. \quad (41)$$

Wherein $$P_t^{cdq}$$

is a waste real power generation power, $\lambda_{cdq}$ is a power generation coefficient, $P_{1,t}$ is a coking power, $$P_{min}^{cdq} \text{ and } P_{max}^{cdq}$$

are a lower output limit and an upper output limit of a coke dry quenching waste heat unit, respectively.

Step 4. introducing the short-process electric arc furnace steel-making production process as a low-carbon process into the material model of the long-process steel enterprise process to form a material-energy characteristic model of the long-process steel enterprise production process based on the warehouse storage model, the air compression system model, the gas system model, the cogeneration unit model, and the coke dry quenching waste heat recovery model. In some embodiments, the energy includes electrical energy, heat energy, and oxygen energy, or the like.

In some embodiments, constraints of the material-energy characteristic model of the long-process steel enterprise production process are as follows.

$$P_{total,t} = \sum_{j=1} G_{j,t} \cdot P_j \forall t, \forall j \in \{1, 2, 3, 4, 5, 6, 7\}, \quad (42)$$

$$P_t^{pv} + P_t^{chp} + P_t^{grid} + P_t^{cdq} = P_{ca,t} + P_{total,t} + P_{load}, \quad (43)$$

$$V_{o,t} = V_{o,t-1} + f_{o,t}^{prod} - \sum_j f_{j,o,t} - f_{o,t}^{chp}, \quad (44)$$

$$Q_t^{chp} = \sum_{j=1} G_{j,t} \cdot Q_j + H_{load} \forall t, \forall j \in \{1, 2, 3, 4, 5, 6, 7\}, \quad (45)$$

$$p_{ca,t} \cdot \psi_{ca} = \sum_{j=1} G_{j,t} \cdot A_j \forall t, \forall j \in \{1, 2, 3, 4, 5, 6, 7\}, \quad (46)$$

$$G_{7,t} \le F_{sum,task}. \quad (47)$$

Wherein Equations (42) and (43) are active power balance constraints, Equation (44) is a gas energy balance constraint, Equation (45) is a heat energy balance constraint, Equation (46) is a compressed air energy balance constraint, and Equation (47) is a total production task constraint, $G_{j,t}$ is an output of the production process j, and j∈{1,2,3,4,5,6,7}, $P_{total,t}$ is a total production load of the process, $P_j$ is an unit production fixed load of the production process j∈{1,2,3,4,5,6,7}, $$P_t^{pv}$$

is a photovoltaic output power, $$P_t^{chp}$$

is an output power of the cogeneration unit, $$P_t^{grid}$$

is a power of electricity purchased from the higher grid, $P_{load}$ is a rest electrical load of enterprise operation, $Q_j$ is thermal energy required for the production process j, j∈{1,2,3,4,5,6,7}, $H_{load}$ is a rest thermal load of enterprise operation, $\psi_{ca}$ is an efficiency of conversion of electrical energy into gas energy, $A_j$ is a unit gas consumption of the production process j, j∈{1,2,3,4,5,6,7}, $F_{sum,task}$ is a total task volume of the processes.

The power of electricity purchased from the superior grid refers to a power of electricity that is purchased from the superior grid (a grid external to a power system of the enterprise, etc.). The rest electrical load of enterprise operation refers to the electrical load of an enterprise running of other equipment or processes. The rest thermal load of enterprise operation refers to a heat load of the enterprise running other equipment or processes.

Figure 4:
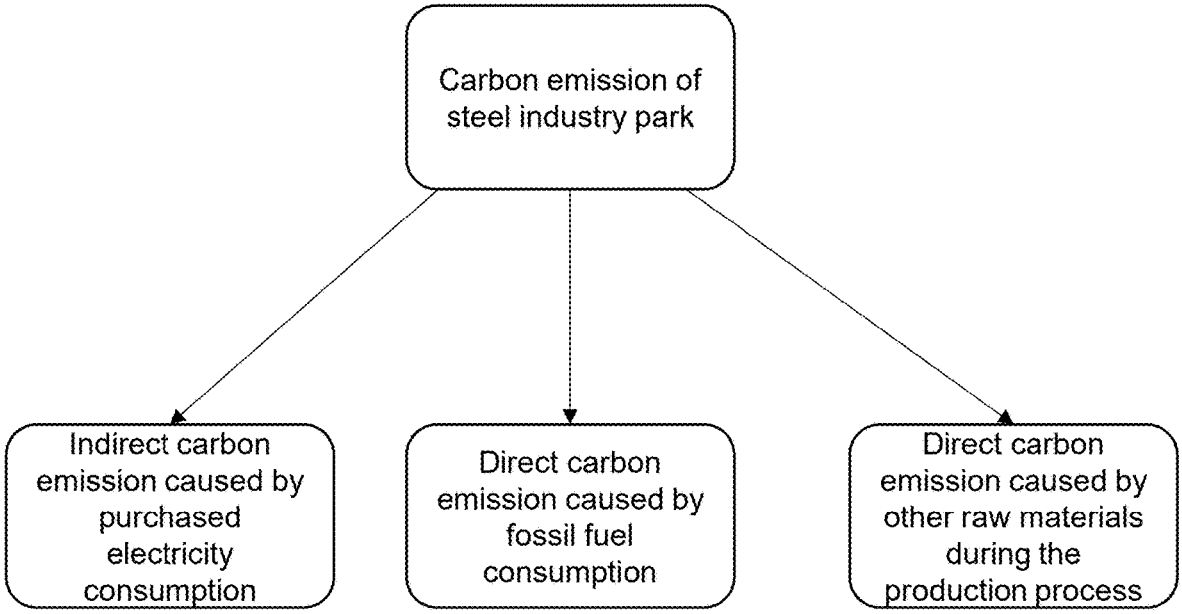
FIG. 4 is a schematic diagram of the sources of carbon emissions from the long-process steel enterprise according to some embodiments of the present disclosure.

FIG. 4 is a schematic diagram of the sources of carbon emissions from the long-process steel enterprise according to some embodiments of the present disclosure.

Step 5. constructing a carbon emission model of the steel enterprise. The carbon emission model of the steel enterprise includes: an indirect carbon emission model of purchased electricity consumption, a direct carbon emission model of coke consumption, a carbon emission model of a production process after attribution, and a carbon emission model of the by-product gas.

In some embodiments, the power system carbon emissions are calculated based on fossil fuel consumption within a region, which does not allow for the carbon emissions to be accurately implemented to each power user. In contrast, the theory of power system carbon emissions flow is able to determine the carbon emissions of any power user at any node based on power flow and the structure of the power network, which in turn clarifies the low-carbon responsibility of the power user. Accordingly, in some embodiments, a dynamic carbon emission factor may be introduced to calculate the carbon emissions generated by power consumption during different time periods. Power flow refer to a state of distribution of voltages at various nodes and active and reactive power at various branches of a power system under a steady state operating condition.

In some embodiments, while direct carbon emission is resulted from consumption of fossil energy, substances such as coke and coal may be partially converted to the by-product gas during production, and the storable nature of the by-product gas results in time-varying carbon emissions.

In some embodiments, the direct carbon emissions due to other raw materials in the production process are related to the process output.

In some embodiments, the processor may construct the carbon emission model of the steel enterprise based on the above.

TABLE 1

Carbon emission coefficients of processes/substances in steel enterprises

| Process | Carbon emission coefficient ($kgCO_2/t$) | Material | Carbon content coefficient |
|---|---|---|---|
| Coking | 367.2 | Coke | 3.11 $kgCO_2/kg$ |
| Sintering | 245.7 | Coke oven gas | 0.792 $kg/m^3$ |

TABLE 1-continued

Carbon emission coefficients of processes/substances in steel enterprises

| Process | Carbon emission coefficient ($kgCO_2/t$) | Material | Carbon content coefficient |
|---|---|---|---|
| Pelletizing | 46.9 | Blast furnace gas | 0.95 $kg/m^3$ |
| Blast furnace iron-making | 522.5 | Converter gas | 1.47 $kg/m^3$ |
| Converter steel-making | 211.5 | | |
| Electric arc furnace steel-making | 169 | | |
| Steel-rolling | 74 | | |

(1) constructing the indirect carbon emission model of the purchased electricity consumption:

$$E_{carbon}^{grid,t} = \rho_{elec,t} P_t^{grid}. \tag{48}$$

Wherein $$E_{carbon}^{grid,t}$$

is a carbon emission of purchased electricity, $\rho_{elec,t}$ is a carbon content coefficient of the purchased electricity, and $$P_t^{grid}$$

is the power purchased from the superior grid.

(2) constructing the direct carbon emission model of the coke consumption:

$$E_{carbon}^{coke,t} = \rho_{elec,t} F_t^{coke}. \tag{49}$$

Wherein $$E_{carbon}^{coke,t}$$

is a carbon emission of coke, $\rho_{coke}$ is a carbon content coefficient of the coke, $$F_t^{coke}$$

is coke consumption.

(3) constructing the carbon emission model of the production process after the attribution:

$$E_{carbon}^{y,t} = \sum_{j=1} G_{j,t} \cdot \rho_j \forall t, \forall j \in \{1, 2, 3, 4, 5, 6, 7\}. \tag{50}$$

Wherein $$E_{carbon}^{y,t}$$

is a total carbon emission of the production process, $\rho_j$ is a fixed carbon emission coefficient of the production process j, $G_{j,t}$ is the output of production process j, and $j \in \{1,2,3,4,5,6,7\}$.

(4) constructing the carbon emission model of the by-product gas:

$$E_{carbon}^{gas,t} = \sum_o \rho_o^{gas} \left( \sum_j f_{j,o,t} + f_{o,t}^{chp} \right) - \sum_o \rho_o^{gas} f_{o,t}^{prod}. \tag{51}$$

Wherein $$E_{carbon}^{gas,t}$$

is a carbon emission of the by-product gas, $$\rho_o^{gas}$$

is a carbon content coefficient of the by-product gas, $$f_{o,t}^{prod}$$

is the output of the by-product gas, $f_{j,o,t}$ is the demand of process j for by-product gas, and $$f_{o,t}^{chp}$$

is the volume of gas input to the cogeneration unit.

(5) constructing a total carbon emission model of the steel enterprise:

$$E_{carbon}^{total,t} = E_{carbon}^{grid,t} + E_{carbon}^{gas,t} + E_{carbon}^{coke,t} + E_{carbon}^{y,t}. \tag{52}$$

Wherein $$E_{carbon}^{total,t}$$

is a total carbon emission of the steel enterprise.

Step 6. constructing a material flow-energy flow-carbon emission flow coupling model of the long-process steel enterprise, establishing an objective function using a minimize sum of an electricity purchase cost from a superior grid, a park carbon emission cost, and a production raw material cost as an object, and solving and obtaining an optimal operation mode of the joint regulation of the material flow, energy flow, and carbon emission flow in the long-process steel enterprise to realize the joint regulation of the material flow, energy flow, and carbon emission flow in the long-process steel enterprise.

Figure 5:
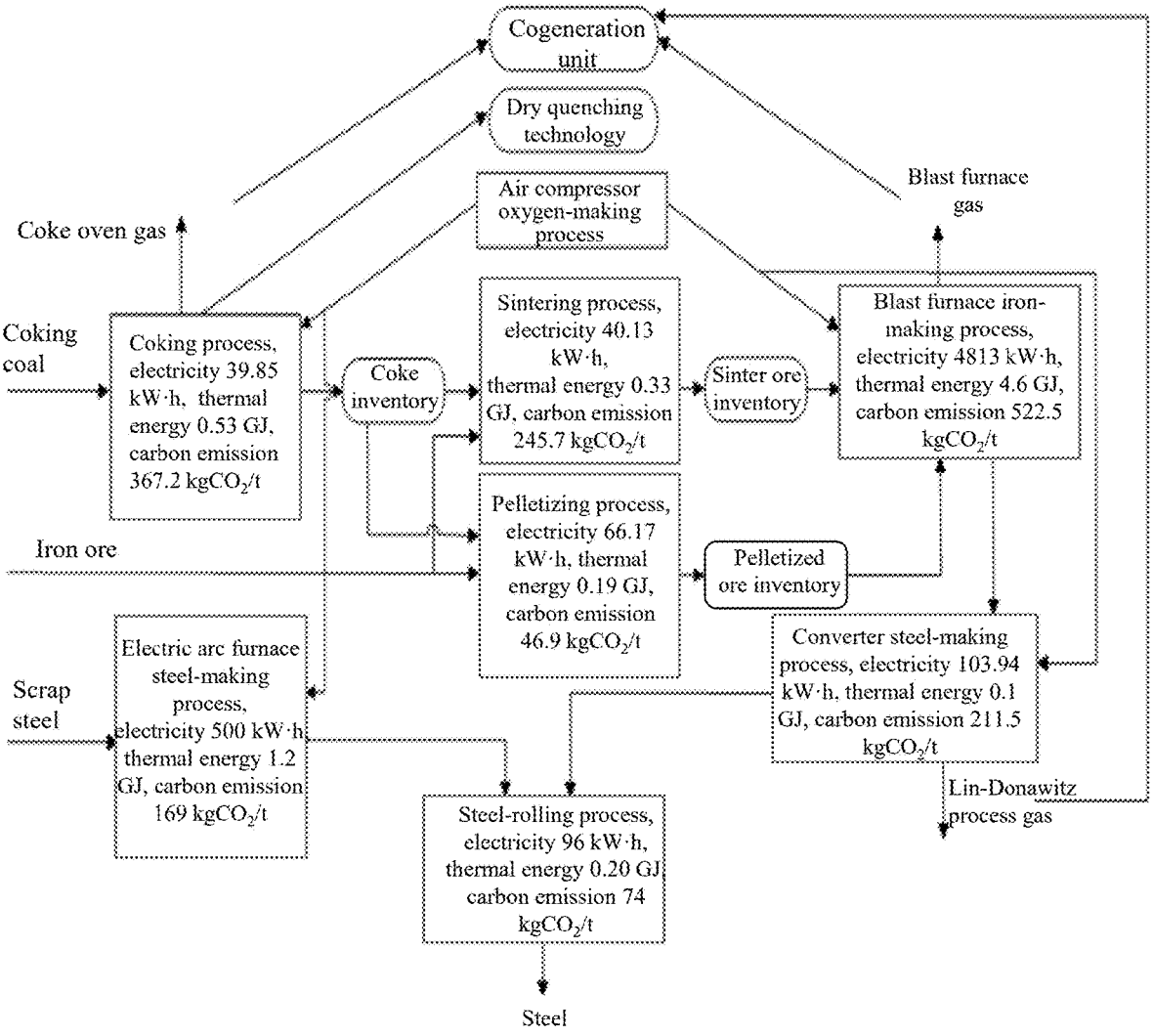
FIG. 5 is a schematic diagram of a material flow-energy flow-carbon emission flow coupling model for the production of 1 ton of steel by the long-process steel enterprise, according to some embodiments of the present disclosure.

FIG. 5 is a schematic diagram of a material flow-energy flow-carbon emission flow coupling model for the production of 1 ton of steel by the long-process steel enterprise according to some embodiments of the present disclosure.

The material flow-energy flow-carbon emission flow coupling model for the production of 1 ton of steel in the long-process steel enterprise is shown in FIG. 5.

In some embodiments, the objective function may be:

$$C_{min} = \sum_t P_t^{grid} \cdot C_{gird,t} \sum_t \left(E_{carbon}^{total,t} - E_{pei,t}\right) \cdot C_{carbon} + \sum_t Y_{1,t} \cdot C_{ljm} + \sum_t Y_{2,t} \cdot C_{tks} + \sum_t Y_{3,t} \cdot C_{fg}. \quad (53)$$

Wherein $C_{min}$ denotes a minimum sum of the electricity purchase cost from the superior grid, the park carbon emission cost, and the production raw material cost, $C_{gird,t}$ is a time-of-use tariff, $E_{pei,t}$ is a free carbon emission allowance, $C_{carbon}$ is a fixed carbon price, $C_{ljm}$ is an unit ton price of production raw material 1, which is the unit ton price of the coking coal, $C_{tks}$ is an unit ton price of production raw material 2, which is the unit ton price of the iron ore, $C_{fg}$ is an unit ton price of production raw material 3, which is the unit ton price of scrap steel.

TABLE 2

Parameters of energy use in steel enterprises for the production of 1 ton of steel

| Process | Thermal energy (GJ) | Electricity (kW · h) |
|---|---|---|
| Coking | 0.53 | 39.85 |
| Sintering | 0.33 | 40.13 |
| Pelletizing | 0.19 | 66.17 |
| Blast furnace iron-making | 4.6 | 48.13 |
| Converter steel-making | 0.1 (100% molten iron) | 103.934 |
| electric arc furnace steel-making | 1.2 | 500 |
| Steel-rolling | 0.20 | 96 |

In some embodiments, the processor may construct an energy flow-carbon emission flow coupling model for the production of 1 ton of steel by the long-process steel enterprise by incorporating a carbon emission model into the energy use model for production of 1 ton of steel by the long-process steel enterprise with a low-carbon process, as shown in Table 3.

TABLE 3

Data on energy flow-carbon emission flow of the process of producing 1 ton of steel in steel enterprise

| Process | Thermal energy (GJ) | Electricity (kW · h) | Carbon emission coefficient ($kgCO_2/t$) | Material | Carbon content coefficient |
|---|---|---|---|---|---|
| Coking | 0.53 | 14 | 367.2 | Coke | 3.11 $kgCO_2/kg$ |
| Sintering | 0.33 | 40.13 | 245.7 | Coke oven gas | 0.792 $kg/m^3$ |
| Pelletizing | 0.19 | 10 | 46.9 | Blast furnace gas | 0.95 $kg/m^3$ |
| Blast furnace iron-making | 9.96 | 21 | 522.5 | Converter gas | 1.47 $kg/m^3$ |
| converter steel-making | 0 | 35.5 | 211.5 | | |
| Electric arc furnace steel-making | 1.51 | 200 | 169 | | |
| Steel-rolling | 0.20 | 96 | 74 | | |

$Y_{1,t}$ is an input raw material quantity of production raw material 1, i.e., a coking coal input quantity, $Y_{2,t}$ is an input raw material quantity of production raw material 2, i.e., an iron ore input quantity, and $Y_{3,t}$ is an input raw material quantity of production raw material 3, i.e., a scrap steel input quantity.

In some embodiments, the processor may introduce an enterprise carbon emission flow based on a material flow-energy flow model of the long-process steel enterprise to construct the material flow-energy flow-carbon emission flow coupling model of the long-process steel enterprise, as described in more detail hereinafter.

Heat and power are consumed by a plurality of production processes of the long-process steel enterprise. In some embodiments, the processor may construct an energy use model based on actual data for production of 1 ton of steel, as shown in Table 2. The processor may convert the heat demand of the production process to a thermodynamic limit energy consumption, which only considers the energy that must be consumed by the process of the raw materials forming a product through a series of physicochemical reactions, containing the heat of warming, heat of phase change, heat of reaction, heat of dissolution, and rolling deformation work.

In some embodiments, after the material flow-energy flow-carbon emission flow coupling model for the production of 1 ton of steel by the long-process steel enterprise is constructed, the processor may perform a joint regulation of energy flow-carbon emission flow in response to a time-of-use tariff signal and a carbon price signal through the regulation of material flow as well as the starting and stopping of a short-process electric arc furnace steel-making process.

In some embodiments, the processor may optimize the scheduling of the long-process steel enterprise operation mode accordingly based on daily deliveries, weekly deliveries, monthly deliveries, quarterly deliveries, and yearly deliveries of the enterprise steel. The processor may optimize scheduling in response to the time-of-use tariff signal and the carbon price signal with a minimum sum of the electricity purchase cost from the superior grid, the park carbon emission cost, and the production raw material cost as the objective function and realize the joint regulation of material flow-energy flow-carbon emission flow through regulating the material flow and starting and stopping the electric arc furnace.

Figure 6:
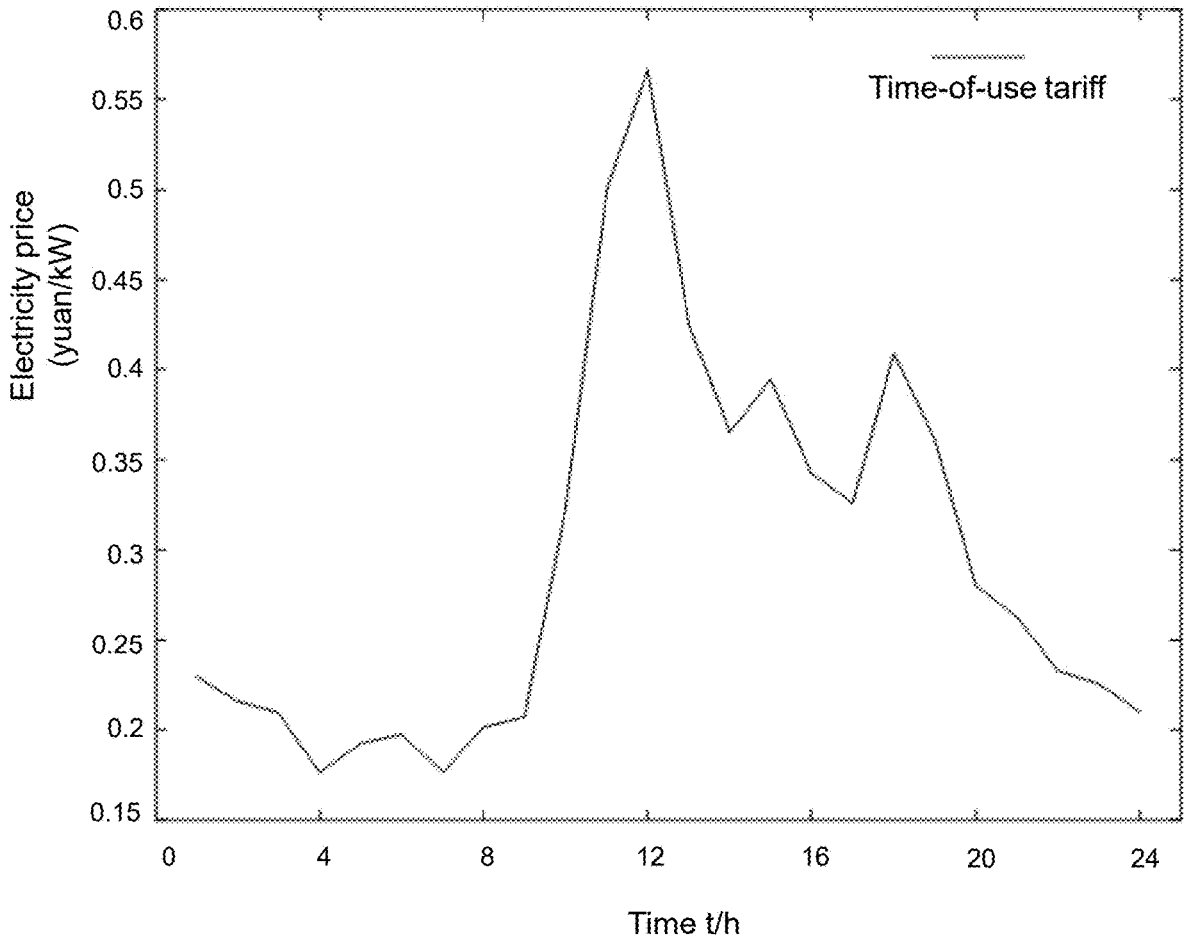
FIG. 6 is a graph of a time-of-use tariff parameter according to some embodiments of the present disclosure.
Figure 7:
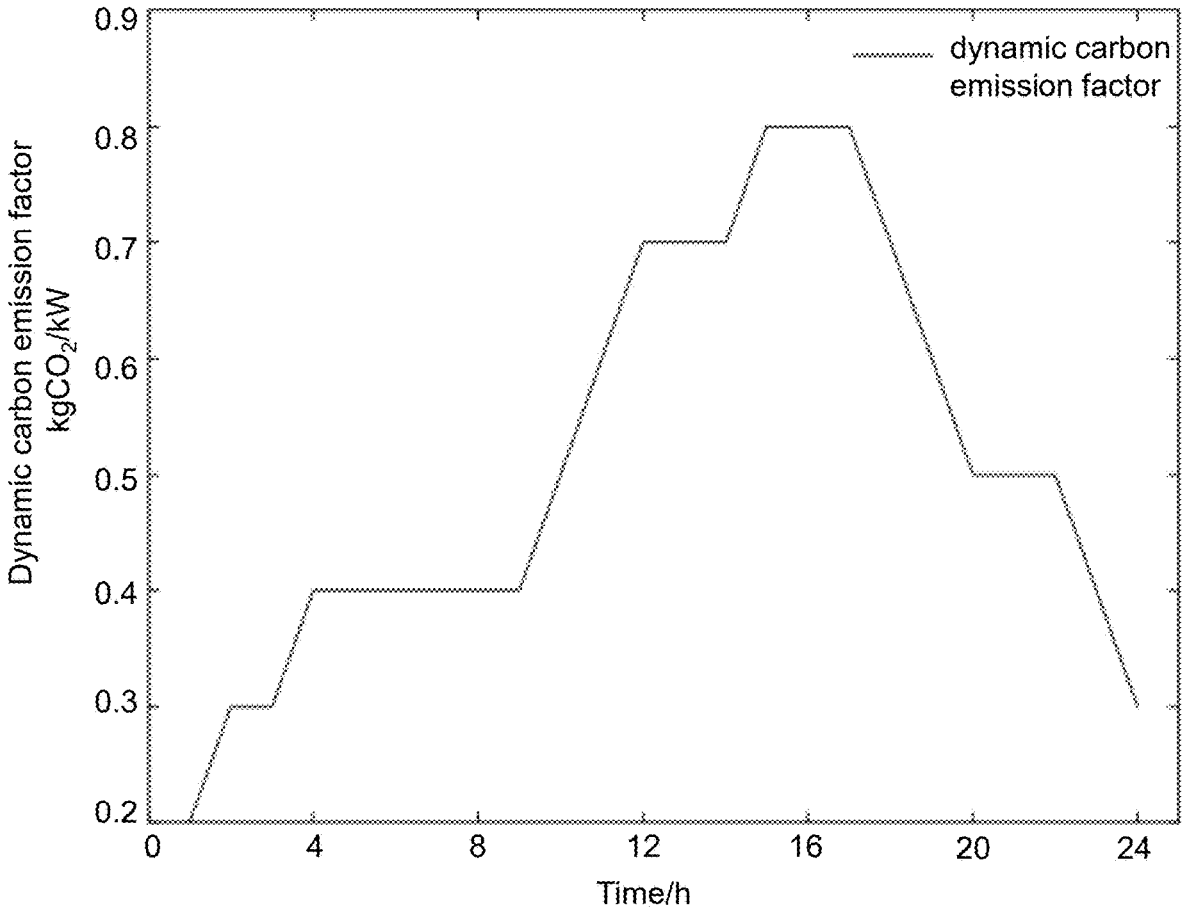
FIG. 7 is a graph of a dynamic carbon emission factor parameter of the power grid according to some embodiments of the present disclosure.
Figure 8:
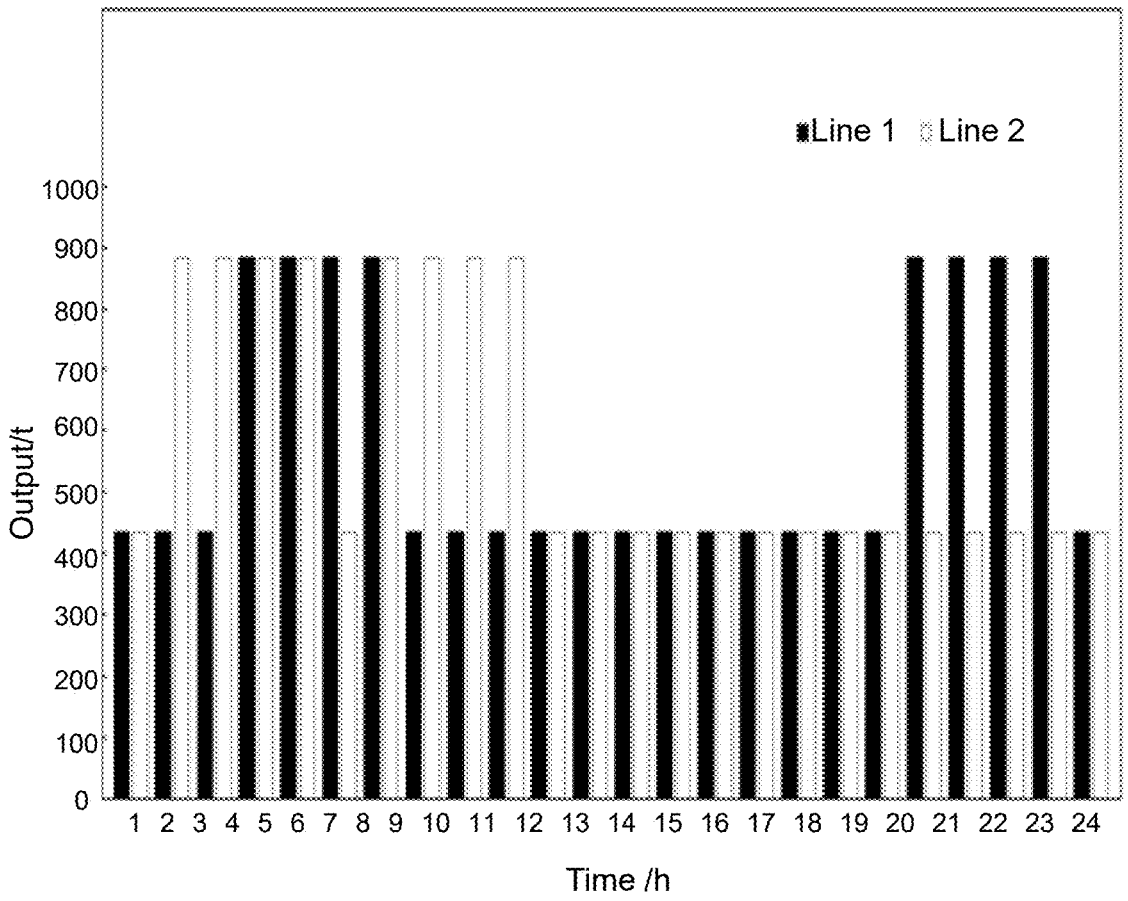
FIG. 8 is a graph of an optimized output of the long-process steel enterprise according to some embodiments of the present disclosure.

FIG. 6 is a graph of a time-of-use tariff parameter according to some embodiments of the present disclosure. FIG. 7 is a graph of a dynamic carbon emission factor parameter of the power grid according to some embodiments of the present disclosure. FIG. 8 is a graph of an optimized output of the long-process steel enterprise according to some embodiments of the present disclosure.

In some embodiments, the time-of-use tariff parameter is shown in FIG. 6. The dynamic carbon emission factor parameter of the power grid is shown in FIG. 7. The optimized output of the long-process steel enterprise is shown in FIG. 8.

In some embodiments, as shown in FIG. 8, an electric arc furnace steel-making process line 1 is in start-up operation from 4:00-7:00 a.m., and then later operates from 8:00-11:00 p.m., resulting in an increase output in a steel-rolling process line 1 at the corresponding time. The electric arc furnace steel-making process production line 2 starts up from 2:00-5:00 a.m., then stops for one hour, and then starts up from 7:00-10:00 a.m., resulting in an increase output in the steel-rolling process production line 2 at the corresponding time.

Figure 9:
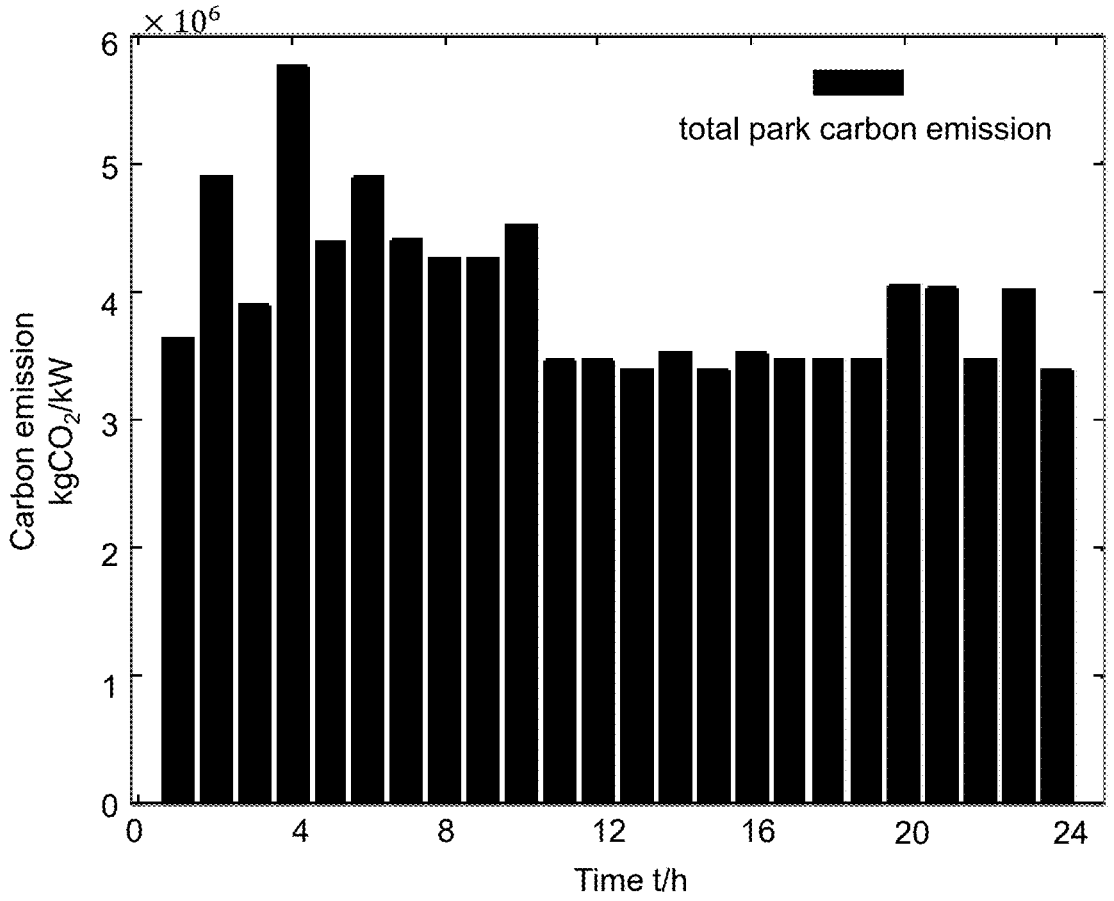
FIG. 9 is a graph of an optimized total park carbon emission of the long-process steel enterprise according to some embodiments of the present disclosure.
Figure 10:
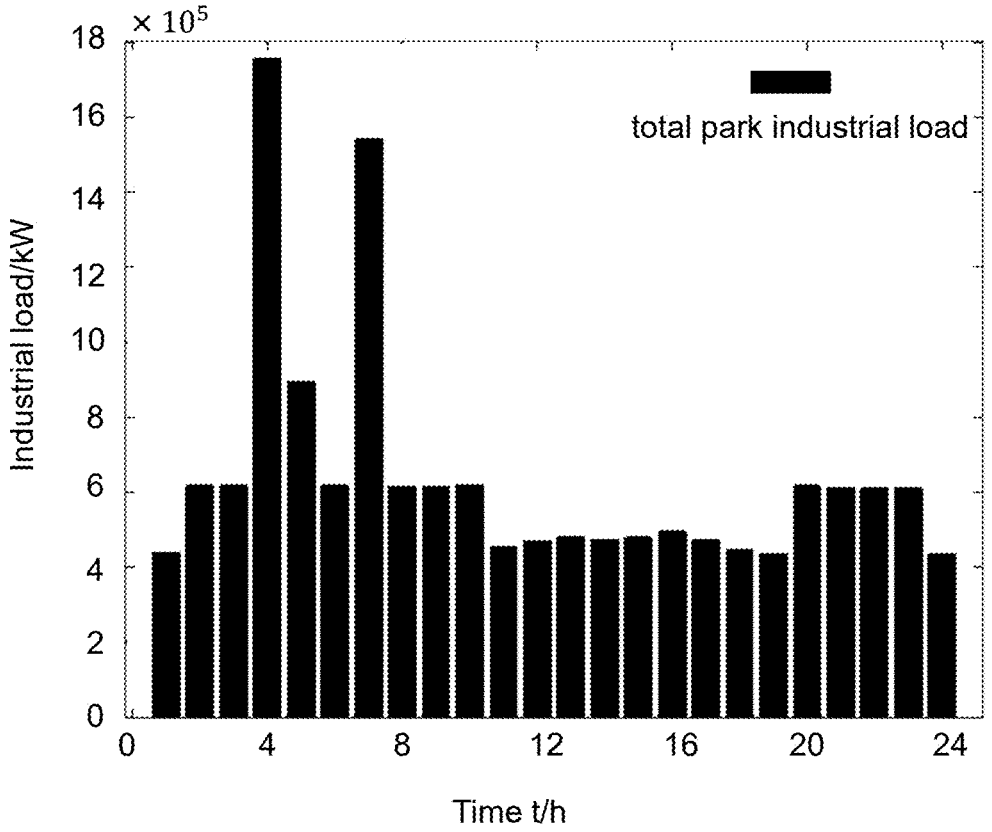
FIG. 10 is a graph of an optimized total park industrial load of the of the long-process steel enterprise according to some embodiments of the present disclosure.

FIG. 9 is a graph of an optimized total park carbon emission of the long-process steel enterprise according to some embodiments of the present disclosure. FIG. 10 is a graph of an optimized total park industrial load of the long-process steel enterprise according to some embodiments of the present disclosure.

In some embodiments, the optimized total park carbon emission of the long-process steel enterprise is shown in FIG. 9. The optimized total park industrial load of the long-process steel enterprise is shown in FIG. 10. The joint regulation method provided by one or more embodiments of the present disclosure can explore the potential of carbon emission reduction of the enterprise, reduce the cost of operation and carbon emissions, and promote the low-carbon transformation of the iron and steel production process, which is convenient for the subsequent study of the electricity-carbon-green certificate market trading mechanism.

In some embodiments, the processor may generate a plurality of candidate production plans, determine a target production plan based on the objective function and the plurality of candidate production plans, control at least one of production equipment and conveying equipment to operate based on the target production plan. More descriptions regarding the objective function may be found in FIG. 2 and relevant descriptions.

The conveying equipment refers to a device used to convey materials between a plurality of processes. For example, a robotic arm, a conveyor belt, or the like.

The production equipment refers to a device used in the production of steel. In some embodiments, each of the plurality of processes may correspond to one or more production equipment. For example, the coking process corresponds to a coke oven, the blast furnace iron-making process corresponds to a blast furnace, or the like.

The candidate production plan refers to a production plan to be determined as the target production plan. The target production plan refers to a production plan based on which the steel enterprise performs production.

In some embodiments, the production plan may include material flow parameters and process parameters for each of the plurality of processes, etc. The plurality of processes may include a coking process, a sintering process, a pelletizing process, or the like. More descriptions regarding the plurality of processes may be found in FIG. 2 and relevant descriptions The material flow parameters may include raw material input quantity and/or raw material ratios, distribution of intermediate product or by-products, product deliveries, etc. For example, a quality and/or ratio of coke and iron ore input into the sintering process, ratios of coke output from the coking process input into the sintering process, the pelletizing process, and the blast furnace ironmaking process, etc.

Exemplarily, the production plan may include an input quality and/or ratio of raw materials (e.g., coking coal, etc.) in the coking process, process parameters (e.g., coking ratio, etc.), and ratios of intermediate product coke that needs to flow to the sintering process, the pelletizing process, and the blast furnace ironmaking process, etc.

In some embodiments, the production plan may also include energy allocation data, etc. The energy allocation data refers to data related to energy procurement or distribution. The energy allocation data may include, for example, a power of electricity purchased from the superior grid under time-of-use tariff signal.

In some embodiments, the processor may obtain the candidate production plans in a plurality of ways. For example, the processor may randomly generate a plurality of candidate production plans within a preset parameter range. The preset parameter range is a range of parameters that are acceptable to the production equipment or the production process, such as the operating hours of the electric arc furnace, the coking ratio that can be achieved by the coking process, or the like. The coking ratio refers to an amount of coking coal required to produce a unit amount of coke.

In some embodiments, the processor may also filter a target production plan with a better production effect in the historical data as a candidate production plan based on the historical data. The criteria for measuring production effects may include output rates, energy consumption, and carbon emissions, etc. The processor may use a target production plan with an output rate greater than an output rate threshold, an energy consumption less than an energy consumption threshold, and a carbon emission less than a carbon emission threshold from the historical data as a candidate production plan. The output rate threshold, the energy consumption threshold, and the carbon emission threshold may be pre-set based on historical experience.

In some embodiments, the processor may also generate the candidate production plan based on the preset production rules. The preset production rules refer to production rules for special cases, such as running an electric arc furnace at full capacity when the time-of-use tariff signal is low. The preset production rules may be pre-set based on historical experience.

In some embodiments, after obtaining the plurality of candidate production plans, the processor may remove candidate production plans whose parameters do not satisfy a safe production condition from the plurality of candidate production plans. The safe production condition may be pre-set based on historical experience, including minimum and/or maximum values for each parameter, the maximum operating time for the production equipment, or the like. Failure to meet the safe production condition may include falling below the minimum value of the parameter or rising above the maximum value of the parameter and exceeding the maximum run time of the production equipment.

In some embodiments, the candidate production plans obtained by the processor all satisfy a plurality of constraints of steps 1-4 of FIG. 2.

In some embodiments, the processor may generate the plurality of candidate production plans based on raw material data and environmental data.

The raw material data refers to data related to raw materials input to the plurality of processes, for example, the impurity content of iron ore input to the pelletizing process and the impurity content of scrap steel input to an electric arc furnace steel-making process.

The environmental data refers to data related to the production environment of the plurality of processes, for example, ambient temperature, ambient humidity, and ambient light, etc.

In some embodiments, the processor may obtain the raw material data and the environmental data through, for example, user (e.g., operator, etc.) input, etc. Users may determine the raw material data and the environmental data through instrumental measurements and other ways.

In some embodiments, the processor may also obtain the environmental data through a plurality of sensors set up on the plurality of production equipment. The plurality of sensors includes temperature sensors, humidity sensors, and light intensity sensors, etc.

In some embodiments, the processor may construct a feature vector based on the raw material data and the environmental data, retrieve a reference feature vector that satisfies a retrieval condition with a feature vector in a vector database, and treat the production plan corresponding to the plurality of reference feature vectors as the plurality of candidate production plans. The retrieval condition includes a vector similarity greater than a similarity threshold. The similarity threshold is pre-set based on historical experience. The vector similarity is negatively correlated to a vector distance. The vector distance includes Euclidean distance, etc.

In some embodiments, the vector database may be pre-set based on the historical data, including a plurality of reference feature vectors and a production plan corresponding to each reference feature vector. For example, the processor may screen, based on the historical data, the production plan with a better production effect in the historical data, construct, based on the historical raw material data and the historical environmental data in the historical production process corresponding to the obtained production plan, a reference feature vector, and take the target production plan corresponding to the historical production process as the production plan corresponding to the reference feature vector. The type of the vector database may include Milvus or Faiss, or the like.

In some embodiments of the present disclosure, based on the raw material data and the environmental data in the actual production process, a candidate production plan that is more in line with the production requirements or the safety of the production can be obtained, which in turn facilitates the subsequent determination of a more appropriate target production plan.

In some embodiments, the processor may determine the target production plan based on the objective function and the plurality of candidate production plans. For example, the processor may substitute, based on the objective function and the plurality of candidate production plans, the relevant parameters in the plurality of candidate production plans into the objective function in turn, and take the candidate production plan whose objective function value satisfies a first screening condition as the target production plan. The first screening condition may include, for example, a minimum objective function value. The relevant parameters may include an electricity purchase cost from a superior grid, a park carbon emission cost, and a production raw material cost, etc.

In some embodiments of the present disclosure, the processor may calculate a product of a running time and a power of electricity purchased from the superior grid based on a power of electricity purchased from the superior grid in the candidate production plan and the running time of all of the production equipment to obtain the total power. The processor may calculate the product of the total power and the time-of-use tariff to obtain the power of electricity purchased from the superior grid.

In some embodiments of the present disclosure, the processor may calculate, based on the candidate production plan, to obtain the total carbon emission of the steel enterprise using equations (48) to (52) above and obtain the park carbon emission cost by subtracting the total carbon emission of the steel enterprise from the free carbon emission allowance.

In some embodiments of the present disclosure, the processor may obtain the usage amount of a plurality of raw materials (e.g., coking coal, iron ore, scrap steel, etc.) in the candidate production plan and then calculate the product of the purchase cost (e.g., unit ton price, etc.) of each raw material and the corresponding usage amount of the raw material to obtain the cost of each raw material. The processor uses the sum of the costs of a plurality of raw materials as the production raw material cost.

In some embodiments, the processor may also determine, based on the objective function, the plurality of candidate production plans, equipment data, the raw material data, preset period data, process intervention data, and the environmental data, a corresponding estimated error for each candidate production plan of the plurality of candidate production plans. The processor may determine, based on the estimated error, a corrected cost corresponding to each candidate production plan of the plurality of candidate production plans and determine the target production plan based on the corrected cost.

The preset period data refers to a production record of actual production for a preset historical period. The processor may access the preset period data through a storage device.

The process intervention data refers to data related to the circumstances in which a production process is intervened, such as a count of switching between production processes, whether workers intervene in each production process, and a count of interventions. In some embodiments, the process intervention data may be recorded and uploaded to the storage device by, for example, an operator, etc. The processor obtains the process intervention data from the storage device.

The equipment data refers to data related to the production equipment, such as design parameters, a running time, maintenance records, and a failure frequency of the production equipment, etc. The design parameters may include a thickness of a wall of the blast furnace, an efficiency curve of the air compressor, or the like. In some embodiments, the processor may obtain the equipment data through the production equipment or the storage device.

The estimated error refers to an estimated error of the objective function value obtained based on the candidate production plan.

The corrected cost refers to a value after correcting the objective function value obtained based on the candidate production plan.

Understandably, the objective function value obtained based on the candidate production plan may have bias, and a more accurate objective function value may be obtained by estimating possible bias and correcting the objective function value.

In some embodiments, the processor may determine, based on the objective function, an individual candidate production plan, the equipment data, the raw material data, the preset period data, the process intervention data, and the environmental data, an estimated error corresponding to the individual candidate production plan through an error estimation model.

The error estimation model refers to a model for determining the estimation error. In some embodiments, the error estimation model may be a machine learning model. For example, the error estimation model may include any one or a combination of, for example, a Neural Networks (NN) model or other customized model structure.

In some embodiments, the processor may train the error estimation model based on a large count of first training samples with first labels by a gradient descent manner. The first training samples and the first labels may be obtained based on historical data. Each set of training sample of the first training samples may include the objective function, a sample production plan, sample equipment data, sample raw material data, preset period data, sample process intervention data, and sample environmental data, and the first labels of the training sample may be an actual error corresponding to the sample production plan in the first training samples. The actual error may be represented by a value of an actual cost minus a value of the objective function corresponding to the sample production plan.

In some embodiments, the error estimation model may be obtained by training including: inputting a plurality of first training samples with first labels into an initial error estimation model, constructing a loss function based on the first labels and the output results of the initial error estimation model, updating the initial error estimation model iteratively based on the loss function, and completing the training of the error estimation model when the loss function of the initial error estimation model satisfies a preset condition. The preset condition may be that the loss function converges, a count of iterations reaches a set value, or the like.

In some embodiments, the processor may compute the sum of the estimated error and the objective function value corresponding to each candidate production plan to obtain the corrected cost corresponding to each candidate production plan and set the candidate production plan whose corrected cost satisfies the second screening condition as the target production plan. The second screening condition may include a minimum corrected cost, etc.

In some embodiments of the present disclosure, based on evaluating a plurality of data in the production process, a possible error of the objective function value can be predicted, and the objective function value can be corrected based on the estimated error to obtain a more accurate production cost, thus more accurately determining the target production plan with lower cost.

In some embodiments, the processor may control the production equipment for production and/or control the conveying equipment for material transfer between different processes based on the target production plan.

In some embodiments, the processor may control starting and stopping of a coke oven based on a starting time and a stopping time of the coke oven in the target production plan. The processor may also control starting and stopping of an electric arc furnace based on a starting time and a stopping time of the electric arc furnace in the target production plan. The processor may also control an air compressor to operate based on the gas storage volume of the gas storage tank and the out power of the air compressor in the target production plan. The processor may also control the conveying equipment to obtain the coking coal from a coking coal warehouse and add the coking coal to the coke oven based on an addition amount of the coking coal in the target production plan. The processor may also control the conveying equipment to obtain molten iron, produced by the blast furnace iron-making process, from a blast furnace and conveying the molten iron to a converter based on an addition amount of the molten iron in the target production plan. The processor may also control a power purchase module to obtain electricity from a grid (such as a superior grid, etc.) based on the energy allocation data in the target production plan. The power purchase module refers to a software or a module that is used for power trading and power purchase operations. The processor control the other processes similarly based on the target production plan, which is not described herein.

In some embodiments of the present disclosure, by filtering the plurality of generated candidate production plans meeting the production requirements, a target production plan with the lowest production cost can be quickly obtained, and the production equipment and the conveying equipment in the overall production process may be controlled to operate according to the target production plan, realizing joint regulation of material flow, energy flow, and carbon emission flow, and reducing production cost and carbon emission cost.

In some embodiments, the processor may determine the material conversion data based on the raw material data, a preset operating parameter, the candidate input data, the equipment data, and the environmental data. The processor may determine, based on the material conversion data, the objective function, the plurality of candidate production plans, and the preset operating parameter, the target production plan and a target operating parameter, and control the production equipment to operate based on the target operating parameter.

The material conversion data refers to data related to the conversion of inputs and outputs of a production process. In some embodiments, the material conversion data includes, for example, material conversion rates for a plurality of production processes, such as the material conversion rate of the pelletizing process in equation (15) above.

In some embodiments, the processor may determine the material conversion data based on the raw material data, the preset operating parameter, the candidate input data, the equipment data, and the environmental data through a conversion estimation model.

The preset operating parameter refers to a pre-set equipment operating parameter. The equipment operating parameter refers to data related to the operation of the production equipment, for example, the temperature of a coking oven or the rolling speed of a rolling equipment.

In some embodiments, the processor may determine, based on each candidate production plan, the production equipment to be used, obtain the preset operating parameter of the production equipment from the storage device, and obtain the preset operating parameter corresponding to each candidate production plan. The preset operating parameter in the storage device are pre-input by an operator.

The candidate input data refers to an input amount of raw material for each production process in the candidate production plan.

The conversion estimation model refers to a model for determining the material conversion data. In some embodiments, the conversion estimation model may be a machine learning model. For example, the conversion estimation model may include any one or a combination of, for example, a Neural Networks (NN) model or other customized model structure.

In some embodiments, the processor may train the conversion estimation model based on the training sample sets by a gradient descent manner, etc. The training sample sets include a plurality of groups of training samples and labels corresponding to each group of training samples. Each group of training samples includes sample raw material data, the preset operating parameter, sample input data, sample equipment data, and sample environmental data, the labels are actual conversion data. The sample input data refers to a input amount of raw material for each production process in the sample production plan. The actual conversion data refers to actual material conversion data corresponding to the training samples.

In some embodiments, the training samples may be obtained based on historical data. The processor may calculate the material conversion rate corresponding to each process based on the input amount of the raw material and product output corresponding to each process in the training samples in the historical data to obtain actual conversion data.

In some embodiments, the conversion estimation model is trained similarly to the error estimation model.

The target operating parameter refers to an equipment operating parameter based on which the steel enterprise performs production.

In some embodiments, the processor may determine the target production plan and the target operating parameter based on the material conversion data, the objective function, the plurality of candidate production plans, and the preset operating parameter. For example, the processor may adjust, based on the material conversion data and the objective function outputted by the conversion estimation model, the objective function by steps 1-6 in FIG. 2, set the candidate production plan with the new objective function value satisfying the first filtering condition as the target production plan, and take the preset operating parameters corresponding to the target production plan as the target operating parameter.

In some embodiments, the processor may also obtain the plurality of candidate operating parameters based on the raw material data, the equipment data, and the environmental data, and determine a plurality of pieces of estimated conversion data based on the plurality of candidate operating parameters and the plurality of candidate production plans. The processor may determine the target production plan and the target operating parameter based on the plurality of pieces of estimated conversion data, the plurality of candidate production plans, the objective function, and the plurality of candidate operating parameters.

The candidate operating parameter refers to an equipment operating parameter to be determined as the target operating parameter. In some embodiments, the processor may randomly adjust the parameters based on the preset operating parameters to obtain the plurality of candidate operating parameters under the satisfaction of safe production conditions. The processor may also obtain the plurality of candidate operating parameters based on the raw material data, the equipment data, and the environmental data by constructing a feature vector and vector matching. More description about constructing the feature vectors and vector matching may be found the above related content.

The estimated conversion data refers to material conversion data corresponding to the candidate data group. The candidate data group is a combination of the candidate operating parameter and the candidate production plan. In some embodiments, for each candidate production plan, the processor may combine each of the plurality of candidate operating parameter and the candidate production plan to obtain a plurality of candidate data groups.

In some embodiments, the processor may input each candidate data group into the conversion estimation model to obtain estimated conversion data corresponding to each candidate data group. The processor may adjust, based on each of the estimated conversion data and the objective function, the objective function by steps 1-6 in FIG. 2, take the candidate production plan whose new objective function value satisfies the first screening condition as the target production plan, and take the candidate operating parameter of the same group of the candidate production plan as the target operating parameter.

According to some embodiments of the present disclosure, a plurality of different model inputs and model outputs can be obtained by combining the candidate operating parameters and the candidate production plans, which in turn improves the diversity and comprehensiveness of the determination of the target production plan.

In some embodiments, the processor may also control the production equipment to operate based on the target operating parameter. For example, the processor may control a coking temperature and a coking time of a coke oven based on a preparation temperature and a preparation time of the coking process in the target operating parameter. As another example, the processor may also control a blast furnace and pulverized coal blowing equipment to operate based on a preparation temperature of the blast furnace and a coal injection volume of the pulverized coal injection equipment during the blast furnace iron-making process in the target operating parameter. Furthermore, for example, the processor may also control the rolling equipment to operate based on a rolling speed and a rolling temperature of the rolling equipment during the steel-rolling process in the target operating parameter.

In some embodiments of the present disclosure, the material conversion data is estimated when determining the target production plan, it can determine a target production plan and a target operating parameter with a better production effect. At the same time, the production equipment is controlled to operate based on the target operating parameter, ensuring production regularity and product quality.

In addition, certain features, structures, or characteristics of one or more embodiments of the present disclosure may be suitably combined.

In some embodiments, the numerical parameters used in the present disclosure and claims are approximations, which can change depending on the desired characteristics of individual embodiments. In some embodiments, the numerical parameters should take into account the specified number of valid digits and use a general digit retention method. While the numerical domains and parameters used to confirm the breadth of their ranges in some embodiments of this disclosure are approximations, in specific embodiments such values are set to be as precise as possible within the range of feasibility.

In the event of any inconsistency or conflict between the descriptions, definitions, and/or the use of terms in the materials cited in this disclosure and what is stated in this disclosure, the descriptions, definitions, and/or the use of terms in this disclosure shall prevail.

What is claimed is:

1. A joint regulation method of material flow, energy flow, and carbon emission flow in a steel enterprise, wherein the joint regulation of the material flow, the energy flow, and the carbon emission flow is performed by constructing a plurality of models, wherein production processes of the steel enterprise include a coking process, a sintering process, a pelletizing process, a blast furnace iron-making process, a converter steel-making process, an electric arc furnace steel-making process, a steel-rolling process, and an air compressor oxygen-making process that provides oxygen in the coking process, the sintering process, the pelletizing process, the blast furnace iron-making process, the converter steel-making process, the electric arc furnace steel-making process, and the steel-rolling process, wherein process numbers of the coking process, the sintering process, the pelletizing process, the blast furnace iron-making process, the converter steel-making process, the electric arc furnace steel-making process, and the steel-rolling process are from 1 to 7 in sequence, wherein the coking process and the electric arc furnace steel-making process belong to an intermittent output process, the sintering process, the pelletizing process, the blast furnace iron-making process, the converter steel-making process, and the steel-rolling process belong to a continuous output process; the method comprising the following steps, the following steps being carried out in turn, step 1. constructing a material flow model of the electric arc furnace steel-making process, wherein the material flow model of the electric arc furnace steel-making process includes the following constraints:

(1) constructing a continuous constraint for starting and stopping of the electric arc furnace steel-making process:

$$ds_{6,t} + dc_{6,t} \le 1, \tag{1}$$

$$ds_{6,t} - dc_{6,t} = op_{6,t} - op_{6,t-1}, \tag{2}$$

wherein $ds_{6,t}$ is a starting variable of the electric arc furnace steel-making process; $dc_{6,t}$ is a stopping variable of the electric arc furnace steel-making process; $op_{6,t}$ is a running variable of the electric arc furnace steel-making process; and 6 is a process number corresponding with the electric arc furnace steel-making process;

(2) constructing a minimum running time constraint of the electric arc furnace steel-making process:

$$ds_{6,t} + \sum_{\tau=t+1}^{t+Min\,op_6-1} dc_{6,\tau} \le 1, \tag{3}$$

wherein $Minop_6$ is a minimum running time of the electric arc furnace steel-making process;

(3) constructing a maximum running time constraint of the electric arc furnace steel-making process:

$$\sum_{\tau=t}^{t+Max\,op_6-1} dc_{6,\tau} \ge ds_{6,t}, \tag{4}$$

wherein $Maxop_6$ is a maximum running time of the electric arc furnace steel-making process;

(4) constructing a minimum downtime constraint of the electric arc furnace steel-making process:

$$dc_{6,t} + \sum_{\tau=t+1}^{t+Dp_6-1} ds_{6,\tau} \le 1, \tag{5}$$

wherein $Dp_6$ is a minimum downtime of the electric arc furnace steel-making process;

(5) constructing a material flow constraint of the electric arc furnace steel-making process:

$$G_{6,t} = \sum_t op_{6,t} \cdot G_6, \tag{6}$$

wherein $G_{6,t}$ is a product output of the electric arc furnace steel-making process; and $G_6$ is a unit output of the electric arc furnace steel-making process;

step 2. constructing a material model of a steel enterprise process:

(1) constructing a material flow constraint model of the coking process:

$$Y_{1,t} \times k = G_{1,t} \quad \forall t, \tag{7}$$

$$G_{min1} \le G_{1,t} \le G_{max1} \quad \forall t, \tag{8}$$

$$G_{1,t} \times \lambda_{jt2} = M_{jt2} \quad \forall t, \tag{9}$$

$$G_{1,t} \times \lambda_{jt3} = M_{jt3} \quad \forall t, \tag{10}$$

$$G_{1,t} \times \lambda_{jt4} = M_{jt4} \quad \forall t, \tag{11}$$

wherein $Y_{1,t}$ is an input raw material quantity of the coking process, wherein the input raw material is coking coal; k is a coking ratio; $G_{1,t}$ is a product output of the coking process; $\lambda_{jt2}$ is a coke supply and demand ratio of the sintering process; $\lambda_{jt2}$ is a coke supply and demand ratio of the pelletizing process; $\lambda_{jt4}$ is a coke supply and demand ratio of the blast furnace iron-making process; $M_{jt2}$ is a quantity of coke input into the sintering process; $M_{jt3}$ is a quantity of coke input into the pelletizing process; $M_{jt4}$ is a quantity of coke input into the blast furnace iron-making process; $G_{min\ 1}$ and $G_{max\ 1}$ are an output lower limit and a output upper limit of the coking process, respectively;

(2) constructing a material flow constraint model of the sintering process:

$$(M_{jt2} + Y_{2,t} \times \lambda_{tks2}) \times v_2 = G_{2,t} \quad \forall t, \tag{12}$$

$$G_{min2} \le G_{2,t} \le G_{max2} \quad \forall t, \tag{13}$$

$$G_{2,t} \times \lambda_{sjk4} = M_{sjk4} \quad \forall t, \tag{14}$$

wherein $Y_{2,t}$ is an input raw material quantity of the sintering process, wherein the input raw material is iron ore; $v_2$ is a material conversion rate of the sintering process; $\lambda_{tks2}$ is an iron ore supply and demand ratio of the sintering process; $G_{2,t}$ is a product output of the sintering process; $\lambda_{sjk4}$ is an sinter ore supply and demand ratio of the blast furnace iron-making process; $M_{sjk4}$ is a quantity of sinter ore input into the blast furnace iron-making process, and $G_{min\ 2}$ and $G_{max\ 2}$ are an output lower limit and an output upper limit of the sintering process, respectively;

(3) constructing a material flow constraint model of the pelletizing process:

$$(M_{jt3} + Y_{2,t} \times \lambda_{tks3}) \times v_3 = G_{3,t} \quad \forall t, \tag{15}$$

-continued $$G_{min3} \le G_{3,t} \le G_{max\,3} \quad \forall t, \tag{16}$$

$$G_{3,t} \times \lambda_{qtk4} = M_{qtk4} \quad \forall t, \tag{17}$$

wherein $v_3$ is a material conversion rate of the pelletizing process; $G_{3,t}$ is a product output of the pelletizing process; $\lambda_{tks3}$ is an iron ore supply and demand ratio of the pelletizing process; $\lambda_{gtk4}$ is a pellet ore supply and demand ratio of the blast furnace iron-making process; $M_{qtk4}$ is a quantity of pellet ore input into the blast furnace iron-making process; $G_{min\,3}$ and $G_{max\,3}$ are an output lower limit and an output upper limit of the pelletizing process, respectively;

(4) constructing a material flow constraint model of the blast furnace iron-making process:

$$(M_{jt4} + M_{sjk4} \times M_{qtk4}) \times v_4 = G_{4,t} \quad \forall t, \tag{18}$$

$$G_{min4} \le G_{4,t} \le G_{max\,4} \quad \forall t, \tag{19}$$

wherein $v_4$ is a material conversion rate of the blast furnace iron-making process; $G_{4,t}$ is a product output of the blast furnace iron-making process; $G_{min\,4}$ and $G_{max\,4}$ are an output lower limit and an output upper limit of the blast furnace iron-making process, respectively;

(5) constructing a material flow constraint model of the converter steel-making process:

$$G_{4,t} \times v_5 = G_{5,t} \quad \forall t, \tag{20}$$

$$G_{min5} \le G_{5,t} \le G_{max\,5} \quad \forall t, \tag{21}$$

wherein $v_5$ is a material conversion rate of the converter steel-making process; $G_{5,t}$ is a product output of the converter steel-making process; $G_{min\,5}$ and $G_{max\,5}$ are an output lower limit and an output upper limit of the converter steel-making process, respectively;

(6) constructing a material flow constraint model of the steel-rolling process:

$$(G_{5,t} + G_{6,t}) \times v_7 = G_{7,t} \quad \forall t, \tag{22}$$

$$G_{min\,7} \le G_{7,t} \le G_{max\,7} \quad \forall t, \tag{23}$$

wherein $v_7$ is a material conversion rate of the steel-rolling process; $G_{7,t}$ is a product output of the steel-rolling process; $G_{min\,7}$ and $G_{max\,7}$ are an output lower limit and an output upper limit of the steel-rolling process, respectively;

step 3. combining a plurality of constraints obtained in step 2 to construct warehouse storage models, an air compression system model, a gas system model, a cogeneration unit model, and a coke dry quenching waste heat recovery model, wherein the warehouse storage models include a coke warehouse storage model, a sinter ore warehouse storage model, and a pellet ore warehouse storage model:

(1) constructing the warehouse storage models:

$$S_{0,c} + \sum_m M_{m,c,t} - \sum_n Y_{n,c,t} = S_{c,t}, \quad c \in \{1, 2, 3\}, m \in j, n \in j, \quad \underline{j \in \{1, 2, 3, 4, 5, 6, 7\},} \quad t = 1, \tag{24}$$

$$S_{c,t-1} + \sum_m M_{m,c,t} - \sum_n Y_{n,c,t} = S_{c,t}, \quad c \in \{1, 2, 3\}, m \in j, n \in j, \quad \underline{j \in \{1, 2, 3, 4, 5, 6, 7\},} \quad t \ge 2, \tag{25}$$

$$S_{min,c} \le S_{c,t} \le S_{max,c} \quad c \in \{1, 2, 3\}, \quad \forall t, \tag{26}$$

wherein Equations (24) and (25) are storage link balance equations; Equation (26) is an storage link upper and lower limit equation; c is a warehouse serial number; $S_{0,c}$ is an initial storage volume of a warehouse c; $M_{m,c,t}$ is an output of a previous mth process of the warehouse c at the time t; $Y_{n,c,t}$ is an amount of a material required for a following nth process of the warehouse c at the time t; $S_{c,t}$ is a capacity of the warehouse c at the time t; $S_{min,c}$ is an storage capacity lower limit of the warehouse c; and $S_{max,c}$ is an storage capacity upper limit of the warehouse c; wherein j, m, and n are values of the process numbers, m and n are taken from values of j, which is taken from a set {1, 2, 3, 4, 5, 6, 7}, and the set {1, 2, 3, 4, 5, 6, 7} is composed of the process numbers of the coking process, the sintering process, the pelletizing process, the blast furnace iron-making process, the converter steel-making process, the electric arc furnace steel-making process, and the steel-rolling process;

(2) constructing the air compression system model:

$$SA_{ca,t} = SA_{ca,t-1} - SU_{ca,t}\Delta t + \alpha_{ca} P_{ca,t} \Delta t, \tag{27}$$

$$0.8SA_{ca,ini} \le SA_{ca,end} \le 1.2SA_{ca,ini}, \tag{28}$$

$$V_{ca} P_{ca,min} \le SA_{ca,t} \le V_{ca,t} \le V_{ca} p_{ca,max}, \tag{29}$$

$$SA_{ca,t} + op_{ca,t} V_{ca} p_{ca,max} \le 1.1 V_{ca} p_{ca,max}, \tag{30}$$

$$1.1 V_{ca} p_{ca,max} \le Sa_{ca,t} + op_{ca,t} V_{ca} p_{ca,min}, \tag{31}$$

wherein Equation (27) is a gas storage volume balance equation; Equations (28) and (29) are gas storage volume upper and lower limit equations; Equations (30) and (31) are air compressor starting and stopping equations; $SA_{ca,t}$ is a gas storage volume of a gas storage tank at the time t; $SU_{ca,t}$ is a system gas consumption at the time t; $\alpha_{ca}$ is an efficiency of the air compressor; $P_{ca,t}$ is an output power of the air compressor at the time t; $\Delta t$ is an optimization step size of 1 hour; $SA_{ca,ini}$ is a gas storage volume of the gas storage tank at an initial time; $SA_{ca,end}$ is a gas storage volume of the gas storage tank at an ending time; $V_{ca}$ is a volume of the gas storage tank; $p_{ca,min}$ and $p_{ca,max}$ are a allowable minimum pressure and a allowable maximum pressure in the gas storage tank; $op_{ca,t}$ is a running variable of the air compressor at the time t;

(3) constructing the gas system model:

$$f_{COG,t}^{prod} = \mu_{COG} P_{1,t}, \tag{32}$$

$$f_{BFG,t}^{prod} = \mu_{BFG} P_{4,t}, \tag{33}$$

-continued $$f_{LDG,t}^{prod} = \mu_{LDG} P_{5,t}, \quad (34)$$

$$V_{o,t} = V_{o,t-1} + f_{o,t}^{prod} - \sum_j f_{j,o,t} - f_{o,t}^{chp}, \quad (35)$$

$$V_{min,o} \le V_{o,t} \le V_{max,o}, \quad (36)$$

wherein $\mu_{COG}$, $\mu_{BFG}$, $\mu_{LDG}$ are a by-product gas yield of coke oven gas (COG) of the coking process, a by-product gas yield of blast furnace gas (BFG) of the blast furnace iron-making process, and a by-product gas yield of Linz-Donawitz process gas (LDG) of the converter steel-making process, respectively; o is by-product gas; $V_{o,t}$ is the gas storage capacity;

$$f_{o,t}^{prod}$$

is the gas output; $f_{j,o,t}$ is a demand of the process j to the by-product gas o;

$$f_{o,t}^{chp}$$

is a volume or gas input into a cogeneration unit; $V_{min,o}$ and $V_{max,o}$ are a capacity lower limit and a capacity upper limit of a corresponding gas storage tank;

(4) constructing the cogeneration unit model:

$$P_t^{chp}\delta = \theta_{chp} \sum_o f_{o,t}^{chp} \beta_o, \quad (37)$$

$$P_{min}^{chp} \le P_t^{chp} \le P_{max}^{chp}, \quad (38)$$

$$Q_t^{chp} = P_t^{chp} \theta_{chp,heat}, \quad (39)$$

wherein Equation (37) is a conversion formula for conversion of thermal energy to electrical energy, wherein the thermal energy is generated from the combustion of the by-product gas as a fuel in the cogeneration unit; Equation (38) is an upper and lower output limit constraint of the cogeneration unit; Equation (39) is a conversion formula for conversion of the electrical energy to the thermal energy in the cogeneration unit;

$$Q_t^{chp}$$

is steam heat generated by the cogeneration unit;

$$P_t^{chp}$$

is electric power of the cogeneration unit; $\delta$ is an optimized cycle length;

$$P_{min}^{chp} \text{ and } P_{max}^{chp}$$

are a lower output limit and an upper output limit of the cogeneration unit, respectively; $\theta_{chp}$ is an electrical efficiency of the cogeneration unit; $\theta_{chp,heat}$ is a thermal efficiency of the cogeneration unit; $\beta_o$ is a calorific value of the by-product gas o;

(5) constructing the coke dry quenching waste heat recovery model:

$$P_t^{cdq} = \lambda_{cdq} P_{1,t}, \quad (40)$$

$$P_{min}^{cdq} \le P_t^{cdq} \le P_{max}^{cdq}, \quad (41)$$

wherein $$P_t^{cdq}$$

is a waste heat power generation power; $\lambda_{cdq}$ is a power generation coefficient; $P_{1,t}$ is a coking power;

$$P_{min}^{chp} \text{ and } P_{max}^{chp}$$

are a lower output limit and an upper output limit of a coke dry quenching waste heat unit, respectively;

step 4. introducing the electric arc furnace steel-making process into the material model of the steel enterprise process to form a material-energy characteristic model of a steel enterprise production process based on the warehouse storage model, the air compression system model, the gas system model, the cogeneration unit model, and the coke dry quenching waste heat recovery model, wherein the energy includes electrical energy, heat energy, and oxygen energy;

wherein constraints of the material-energy characteristic model of the steel enterprise production process are as follows:

$$P_{total,t} = \sum_{j=1} G_{j,t} \cdot P_j \quad \forall t, \forall j \in \{1, 2, 3, 4, 5, 6, 7\}, \quad (42)$$

$$P_t^{pv} + P_t^{chp} + P_t^{grid} + P_t^{cdq} = P_{ca,t} + P_{total,t} + P_{load}, \quad (43)$$

$$V_{o,t} = V_{o,t-1} + f_{o,t}^{prod} - \sum_j f_{j,o,t} - f_{o,t}^{chp}, \quad (44)$$

$$Q_t^{chp} = \sum_{j=1} G_{j,t} \cdot Q_j + H_{load} \quad \forall t, \forall j \in \{1, 2, 3, 4, 5, 6, 7\}, \quad (45)$$

$$P_{ca,t} \cdot \psi_{ca} = \sum_{j=1} G_{j,t} \cdot A_j \quad \forall t, \forall j \in \{1, 2, 3, 4, 5, 6, 7,\} \quad (46)$$

$$G_{7,t} \le F_{sum,task}, \quad (47)$$

wherein Equations (42) and (43) are active power balance constraints; Equation (44) is a gas energy balance constraint; Equation (45) is a heat energy balance constraint; Equation (46) is a compressed air energy balance constraint; and Equation (47) is a total production task constraint; $G_{j,t}$ is an output of the production process j, wherein $j \in \{1,2,3,4,5,6,7\}$; $P_{total,t}$ is a total production load of the process; $P_j$ is an unit production fixed load of the production process $j \in \{1,2,3,4,5,6,7\}$;

$$P_t^{vv}$$

is a photovoltaic output power;

$$P_t^{chp}$$

is an output power of the cogeneration unit;

$$P_t^{grid}$$

is a power of electricity purchased from the higher grid; $P_{load}$ is a rest electrical load of enterprise operation; $Q_j$ is thermal energy required for the production process j, j∈{1,2,3,4,5,6,7}; $H_{load}$ is a rest thermal load of enterprise operation; $\psi_{ca}$ is an efficiency of conversion of electrical energy into gas energy; $A_j$ is a unit gas consumption of the production process j, j∈{1,2,3,4,5,6,7}; $F_{sum,task}$ is a total task volume of the processes;

step 5. constructing a carbon emission model of the steel enterprise, wherein the carbon emission model of the steel enterprise includes: an indirect carbon emission model of purchased electricity consumption, a direct carbon emission model of coke consumption, a carbon emission model of a production process, and a carbon emission model of the by-product gas;

(1) constructing the indirect carbon emission model of the purchased electricity consumption:

$$E_{carbon}^{grid,t} = \rho_{elec,t} P_t^{grid}, \tag{48}$$

wherein $$E_{carbon}^{grid,t}$$

is a carbon emission or purchased electricity; $\rho_{elec,t}$ is a carbon content coefficient of the purchased electricity;

(2) constructing the direct carbon emission model of the coke consumption:

$$E_{carbon}^{coke,t} = \rho_{coke} F_t^{coke}, \tag{49}$$

wherein $$E_{carbon}^{coke,t}$$

is a carbon emission of coke; $\rho_{coke}$ is a carbon content coefficient of the coke;

$$F_t^{coke}$$

is coke consumption;

(3) constructing the carbon emission model of the production process:

$$E_{carbon}^{y,t} = \sum_{j=1} G_{j,t} \cdot \rho_j \forall t, \forall j \in \{1, 2, 3, 4, 5, 6, 7\}, \tag{50}$$

wherein $$E_{carbon}^{y,t}$$

is a total carbon emission of the production process; $\rho_j$ is a fixed carbon emission coefficient of the production process j;

(4) constructing the carbon emission model of the by-product gas:

$$E_{carbon}^{gas,t} = \sum_o \rho_o^{gas} \left( \sum_j f_{j,o,t} + f_{o,t}^{chp} \right) - \sum_o \rho_o^{gas} f_{o,t}^{prod}, \tag{51}$$

wherein $$E_{carbon}^{gas,t}$$

is a carbon emission of the by-product gas;

$$\rho_o^{gas}$$

is a carbon content coefficient of the by-product gas;

(5) constructing a total carbon emission model of the steel enterprise:

$$E_{carbon}^{total,t} = E_{carbon}^{grid,t} + E_{carbon}^{gas,t} + E_{carbon}^{coke,t} + E_{carbon}^{y,t}, \tag{52}$$

wherein $$E_{carbon}^{total,t}$$

is a total carbon emission of the steel enterprise;

wherein the carbon emission coefficient used in the production process of the steel enterprise is set by referring to actual data from a real steel enterprise;

step 6: constructing a material flow-energy flow-carbon emission flow coupling model of the steel enterprise, wherein the constructing a material flow-energy flow-carbon emission flow coupling model of the steel enterprise includes: introducing the carbon emission model of the steel enterprise based on the material-energy characteristic model of the steel enterprise production process to construct the material flow-energy flow-carbon emission flow coupling model of the steel enterprise; constructing an energy characteristic model based on the actual data from the steel enterprise; converting heat demand of the steel enterprise production process to a thermodynamic limit energy consumption, which considers the energy that is consumed by a process of raw materials forming a product through a series of physicochemical reactions, containing heat of warming, heat of phase change, heat of reaction, heat of dissolution, and rolling deformation work; constructing the energy flow-carbon emission flow coupling model of the steel enterprise by incorporating the carbon emission model; performing the joint regulation of the energy flow and the carbon emission flow in response to a time-of-use tariff signal and a carbon price signal through the regulation of the material flow as well as starting and stopping of the electric arc furnace steel-making process; and optimizing scheduling of the steel enterprise operation mode based on daily deliveries, weekly deliveries, monthly deliveries, quarterly deliveries, and yearly deliveries of the enterprise steel;

establishing an objective function, wherein the objective function is a function that optimizes an optimal operation mode of the joint regulation of the material flow, the energy flow, and the carbon emission flow in the steel enterprise; an optimization object of the objective function is to minimize a sum of an electricity purchase cost from a superior grid, a park carbon emission cost, and a production raw material cost, and solving and obtaining the optimal operation mode of the joint regulation of the material flow, the energy flow, and the carbon emission flow in the steel enterprise to realize the joint regulation of the material flow, the energy flow, and the carbon emission flow in the steel enterprise; wherein the park carbon emission cost is obtained by subtracting the total carbon emission of the steel enterprise from a free carbon emission allowance; the free carbon emission allowance is preset cost free carbon emission; the production raw material cost is a sum of the input raw material quantity of the coking process and an unit ton price of the coking coal, the input raw material quantity of the sintering process and an unit ton price of the sintering process, and the input raw material quantity of the electric arc furnace steel-making process and an unit ton price of the electric arc furnace steel-making process;

wherein the objective function is:

$$C_{min} = \sum_t P_t^{grid} \cdot C_{gird,t} \sum_t \left(E_{carbon}^{total,t} - E_{pei,t}\right) \cdot C_{carbon} + \sum_t Y_{1,t} \cdot C_{ljm} + \sum_t Y_{2,t} \cdot C_{tks} + \sum_t Y_{3,t} \cdot C_{fg}, \quad (53)$$

wherein: $C_{min}$ denotes a minimum sum of the electricity purchase cost from the superior grid, the park carbon emission cost, and the production raw material cost; $C_{gird,t}$ is a time-sharing electricity price, $E_{pei,t}$ is the free carbon emission allowance; $C_{carbon}$ is a fixed carbon price; $C_{ljm}$ is the unit ton price of the input raw material quantity $Y_{1,t}$ of the coking process, which is the unit ton price of the coking coal; $C_{tks}$ is the unit ton price of the input raw material quantity $Y_{2,t}$ of the sintering process, which is the unit ton price of the iron ore; $C_{fg}$ is the unit ton price of the input raw material quantity $Y_{3,t}$ of the electric arc furnace steel-making process, which is the unit ton price of a scrap steel;

optimizing scheduling in response to the time-of-use tariff signal and the carbon price signal and realizing the joint regulation of the material flow, the energy flow, and the carbon emission flow through regulating the material flow and the starting and stopping of the electric arc furnace steel-making process;

the method further comprising:

generating a plurality of candidate production plans; wherein each of the candidate production plans refers to a production plan to be determined as a target production plan; the target production plan refers to a production plan based on which the steel enterprise performs production; and the production plan includes material flow parameters and process parameters for each of the production processes of the steel enterprise;

determining the target production plan based on the objective function and the plurality of candidate production plans; wherein the determining the target production plan based on the objective function and the plurality of candidate production plans including:

substituting, based on the objective function and the plurality of candidate production plans, relevant parameters in the plurality of candidate production plans into the objective function in turn, and taking the candidate production plan whose objective function value satisfies a first screening condition as the target production plan; wherein the first screening condition includes a minimum objective function value; and the relevant parameters include the electricity purchase cost from the superior grid, the park carbon emission cost, and the production raw material cost;

controlling at least one of production equipment and conveying equipment to operate based on the target production plan, including:

controlling starting and stopping of the coke oven based on a starting time and a stopping time of the coke oven in the target production plan;

controlling starting and stopping of the electric arc furnace based on a starting time and a stopping time of the electric arc furnace in the target production plan;

controlling the air compressor to operate based on the gas storage volume of the gas storage tank and an out power of the air compressor in the target production plan;

controlling the conveying equipment to obtain the coking coal from a coking coal warehouse and add the coking coal to the coke oven based on an addition amount of the coking coal in the target production plan;

controlling the conveying equipment to obtain molten iron, produced by the blast furnace iron-making process, from the blast furnace and conveying the molten iron to the converter based on an addition amount of the molten iron in the target production plan; wherein the at least one of production equipment include the coke oven, the electric arc furnace, the air compressor, the blast furnace, the conveying equipment and rolling equipment during the steel-rolling process; wherein the conveying equipment refers to a device used to convey materials between the coking process, the sintering process, the pelletizing process, the blast furnace iron-making process, the converter steel-making process, the electric arc furnace steel-making process, and the steel-rolling process in the production processes of the steel enterprise; and the conveying equipment includes a robotic arm and a conveyor belt; and controlling a power purchase module to obtain electricity from a grid based on energy allocation data in the target production plan.

* * * * *